US010124597B2

(12) United States Patent
Alessi et al.

(10) Patent No.: US 10,124,597 B2
(45) Date of Patent: Nov. 13, 2018

(54) SYSTEM AND METHOD FOR SUPPLYING INK TO AN INKJET PRINTHEAD

(71) Applicant: R.R. DONNELLEY & SONS COMPANY, Chicago, IL (US)

(72) Inventors: George A. Alessi, Buffalo, NY (US); Paul Slagle, Grand Island, NY (US); Kent D. Jayme, Grand Island, NY (US); Anthony V. Moscato, North Tonawanda, NY (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 15/590,597

(22) Filed: May 9, 2017

(65) Prior Publication Data

US 2017/0320331 A1 Nov. 9, 2017

Related U.S. Application Data

(60) Provisional application No. 62/333,514, filed on May 9, 2016.

(51) Int. Cl.
*B41J 2/18* (2006.01)
*B41J 2/175* (2006.01)

(52) U.S. Cl.
CPC ..... *B41J 2/18* (2013.01); *B41J 2/175* (2013.01); *B41J 2/17596* (2013.01)

(58) Field of Classification Search
CPC ..... B41J 2/175; B41J 2/18; B41J 2/17596
See application file for complete search history.

(56) References Cited

U.S. PATENT DOCUMENTS

| | | | |
|---|---|---|---|
| 3,560,641 | A | 2/1971 | Taylor et al. |
| 3,647,138 | A | 3/1972 | Houser |
| 3,723,645 | A | 3/1973 | Takami et al. |
| 3,747,120 | A | 7/1973 | Stemme |
| 3,891,121 | A | 6/1975 | Stoneburner |
| 3,974,508 | A | 8/1976 | Blumenthal |
| 4,042,937 | A | 8/1977 | Perry et al. |

(Continued)

FOREIGN PATENT DOCUMENTS

| | | |
|---|---|---|
| EP | 0 585 901 | 3/1994 |
| EP | 0 749 836 | 12/1996 |

(Continued)

OTHER PUBLICATIONS

Extended European Search Report for European Application No. EP 14154508, dated Nov. 10, 2016 (11 pages).

(Continued)

*Primary Examiner* — John P Zimmermann
(74) *Attorney, Agent, or Firm* — McCracken & Gillen LLC

(57) ABSTRACT

An ink supply unit and a method of supplying ink to a printhead are disclosed. The ink supply unit includes a lower ink reservoir, an upper ink reservoir, and a flow regulation apparatus. The upper ink reservoir is coupled to the lower ink reservoir. First and second fluid input ports are disposed on opposite sides of the flow regulation apparatus. A first fluid line and a second fluid line couple the first and the second input ports, respectively, with the upper ink reservoir, and a third fluid line is adapted to couple the flow regulation apparatus with a printhead.

27 Claims, 10 Drawing Sheets

(56) References Cited

U.S. PATENT DOCUMENTS 4,050,078 A 9/1977 Isayama et al.
4,051,538 A 9/1977 Fox et al.
4,063,254 A 12/1977 Fox et al.
4,067,020 A 1/1978 Arway
4,116,626 A 9/1978 Varner
4,126,868 A 11/1978 Kirner
4,184,167 A 1/1980 Vandervalk
4,208,666 A 6/1980 Paranjpe
4,222,080 A 9/1980 Frazier
4,240,082 A 12/1980 Yu
4,250,512 A 2/1981 Kattner et al.
4,260,996 A 4/1981 Wittwer
4,296,418 A 10/1981 Yamazaki et al.
4,317,124 A 2/1982 Shirato et al.
4,330,787 A 5/1982 Sato et al.
4,340,896 A 7/1982 Cruz-Uribe et al.
4,342,042 A 7/1982 Cruz-Uribe et al.
4,362,572 A 12/1982 Wallace
4,403,229 A 9/1983 Barteck
4,410,897 A 10/1983 Moriguchi et al.
4,432,005 A 2/1984 Duffield et al.
4,494,124 A 1/1985 Piatt et al.
4,520,366 A 5/1985 Cragin, Jr.
4,528,996 A 7/1985 Jones
4,542,389 A 9/1985 Allen
4,571,600 A 2/1986 Hara
4,593,295 A 6/1986 Matsufuji et al.
4,598,303 A 7/1986 Peekema et al.
4,598,329 A 7/1986 Nelson
4,607,266 A 8/1986 DeBonte
4,623,897 A 11/1986 Brown et al.
4,628,329 A 12/1986 Regnault
4,694,307 A 9/1987 Toganoh et al.
4,706,099 A 11/1987 Suzuki
4,734,711 A 3/1988 Piatt et al.
4,764,780 A 8/1988 Yamamori et al.
4,812,859 A 3/1989 Chan et al.
4,814,794 A 3/1989 Sato
4,825,229 A 4/1989 Matsumoto et al.
4,827,278 A 5/1989 Lecheheb
4,835,544 A 5/1989 Winterburn
4,881,132 A 11/1989 Lajos
4,929,963 A 5/1990 Balazar
5,087,805 A 2/1992 Silverschutz et al.
5,121,132 A 6/1992 Pan et al.
5,126,752 A 6/1992 Weinberg
5,126,766 A 6/1992 Terasawa et al.
5,182,578 A 1/1993 Goepel et al.
5,210,550 A 5/1993 Fisher et al.
5,211,493 A 5/1993 Stephenson et al.
5,272,491 A 12/1993 Asakawa et al.
5,330,576 A * 7/1994 Clauditz ..... B41F 23/08 118/602
5,369,429 A 11/1994 Erickson
5,382,969 A 1/1995 Mochizuki et al.
5,428,375 A 6/1995 Simon et al.
5,446,486 A 8/1995 Reis
5,489,925 A 2/1996 Brooks et al.
5,504,510 A 4/1996 Miyakawa
5,512,924 A 4/1996 Takada et al.
5,537,134 A 7/1996 Balwin et al.
5,543,827 A 8/1996 VanSteenkiste et al.
5,555,005 A 9/1996 Pagnon
5,583,544 A 12/1996 Starner et al.
5,585,825 A 12/1996 Kneezel et al.
5,598,198 A 1/1997 Taylor et al.
5,625,396 A 4/1997 Keefe et al.
5,631,676 A 5/1997 Karz
5,646,666 A 7/1997 Cowger et al.
5,657,061 A 8/1997 Seccombe et al.
5,670,995 A 9/1997 Kupcho et al.
5,683,508 A 11/1997 Bleiler et al.
5,691,754 A 11/1997 Ta
5,735,617 A 4/1998 Wirth
5,742,308 A 4/1998 Cowger et al.
5,745,137 A 4/1998 Scheffelin et al.
5,745,138 A 4/1998 Ostermeier
5,751,327 A 5/1998 De Cock et al.
5,757,390 A 5/1998 Gragg et al.
5,757,406 A 5/1998 Kaplinsky et al.
5,765,481 A 6/1998 Tortora et al.
5,774,141 A 6/1998 Cooper et al.
5,784,077 A 7/1998 Silverbrook
5,793,389 A 8/1998 Mitchell
5,796,411 A 8/1998 Cyman et al.
5,797,305 A 8/1998 Harrod et al.
5,801,736 A 9/1998 Ikkatai et al.
5,812,151 A 9/1998 Kishine et al.
5,825,380 A 10/1998 Ichizawa et al.
5,852,458 A 12/1998 Scheffelin et al.
5,877,788 A 3/1999 Haan et al.
5,877,793 A 3/1999 Erickson
5,880,748 A 3/1999 Childers et al.
5,886,718 A 3/1999 Johnson et al.
5,903,293 A 5/1999 Nikkels et al.
5,929,878 A 7/1999 Pelletier
5,949,438 A 9/1999 Cyman et al.
5,963,238 A 10/1999 Scheffelin et al.
5,966,156 A 10/1999 Scheffelin et al.
5,992,975 A 11/1999 Gasvoda et al.
5,992,986 A 11/1999 Gyotoku et al.
5,992,990 A 11/1999 Childers et al.
6,000,792 A 12/1999 Koizumi et al.
6,003,984 A 12/1999 Bohorquez et al.
6,003,988 A 12/1999 McCann et al.
6,012,806 A 1/2000 de Olazabal
6,023,594 A 2/2000 Okiyama et al.
6,030,074 A 2/2000 Barinaga
6,033,061 A 3/2000 Niedermeyer et al.
6,089,693 A 7/2000 Drake et al.
6,120,142 A 9/2000 Eltgen et al.
6,139,136 A 10/2000 Mackay et al.
6,145,971 A 11/2000 Baker et al.
6,161,913 A 12/2000 Childers et al.
6,164,768 A 12/2000 Murphy et al.
6,164,771 A 12/2000 Eckard et al.
6,170,937 B1 1/2001 Childers et al.
6,183,078 B1 2/2001 Pietrzyk et al.
6,188,417 B1 2/2001 Keefe et al.
6,196,668 B1 3/2001 Bode
6,206,510 B1 3/2001 Casserino et al.
6,224,192 B1 5/2001 Robinson et al.
6,224,198 B1 5/2001 Cook et al.
6,227,641 B1 5/2001 Nishikori et al.
6,231,174 B1 5/2001 Haigo
6,234,597 B1 5/2001 Suzuki et al.
6,234,617 B1 5/2001 Niedermeyer et al.
6,267,518 B1 7/2001 Abe
6,273,103 B1 8/2001 Enz et al.
6,273,560 B1 8/2001 Keefe et al.
6,281,916 B1 8/2001 VanSteenkiste
6,318,850 B1 11/2001 Childers et al.
6,335,978 B1 1/2002 Moscato et al.
6,341,853 B1 1/2002 Scheffelin et al.
6,344,904 B1 2/2002 Mercer
6,347,858 B1 2/2002 Faisst, Jr. et al.
6,357,854 B1 3/2002 Igval et al.
6,364,451 B1 4/2002 Silverbrook
6,367,919 B1 4/2002 Taylor et al.
6,371,607 B2 * 4/2002 Wouters ..... B41J 2/175 347/89
6,402,293 B1 6/2002 Sawicki
6,402,306 B1 6/2002 Childers et al.
6,428,156 B1 8/2002 Waller et al.
6,435,637 B1 8/2002 Lyman
6,450,629 B2 9/2002 Childers
RE37,874 E 10/2002 Pawlowski, Jr. et al.
6,457,802 B2 10/2002 Jackson
6,460,441 B1 10/2002 Harrod
6,464,346 B2 10/2002 Otis, Jr. et al.
6,467,874 B1 10/2002 Williams et al.
6,491,365 B2 12/2002 Sonobe
6,508,545 B2 1/2003 Dowell et al.
6,530,644 B2 3/2003 Premnath et al.

(56) References Cited

U.S. PATENT DOCUMENTS

| | | | |
|---|---|---|---|
| 6,536,863 | B1 | 3/2003 | Beauchamp et al. |
| 6,543,877 | B1 | 4/2003 | Boutet et al. |
| 6,547,370 | B2 | 4/2003 | Mantell et al. |
| 6,575,554 | B2 | 6/2003 | Yoshinaga |
| 6,585,350 | B2 | 7/2003 | Barinaga |
| 6,601,951 | B2 | 8/2003 | Kuwabara et al. |
| 6,604,813 | B2 | 8/2003 | Green |
| 6,637,860 | B1 | 10/2003 | Madeley |
| 6,648,434 | B2 | 11/2003 | Walker et al. |
| 6,660,103 | B1 | 12/2003 | Johnston et al. |
| 6,663,220 | B2 | 12/2003 | Suzuki et al. |
| 6,663,304 | B2 | 12/2003 | Vives et al. |
| 6,669,327 | B1 | 12/2003 | Harper |
| 6,672,702 | B2 | 1/2004 | Sadasivan et al. |
| 6,679,590 | B2 | 1/2004 | Enz |
| 6,679,592 | B2 | 1/2004 | Casserino et al. |
| 6,688,721 | B1 | 2/2004 | Serra |
| 6,698,869 | B2 | 3/2004 | Vosahlo |
| 6,705,711 | B1 | 3/2004 | Richards |
| 6,733,106 | B1 | 5/2004 | Leemhuis |
| 6,733,115 | B2 | 5/2004 | Santhanam et al. |
| 6,773,097 | B2 | 8/2004 | Dowell |
| 6,779,875 | B2 | 8/2004 | Pawlowski, Jr. et al. |
| 6,802,588 | B2 | 10/2004 | Garbacz et al. |
| 6,808,246 | B2 | 10/2004 | Long |
| 6,811,249 | B2 | 11/2004 | DeVries et al. |
| 6,830,315 | B2 | 12/2004 | Silverbrook et al. |
| 6,840,604 | B2 | 1/2005 | Kimura et al. |
| 6,843,553 | B2 | 1/2005 | Ishii et al. |
| 6,869,160 | B2 | 3/2005 | West et al. |
| 6,880,912 | B2 | 4/2005 | Klausbruckner et al. |
| 6,883,905 | B2 | 4/2005 | Kimura et al. |
| 6,890,053 | B2 | 5/2005 | Myhill et al. |
| 6,908,165 | B2 | 6/2005 | Pinard |
| 6,916,132 | B2 | 7/2005 | Otsuka et al. |
| 6,935,729 | B2 | 8/2005 | De Marco et al. |
| 6,991,311 | B2 | 1/2006 | Su et al. |
| 7,004,573 | B2 | 2/2006 | Hewitt |
| 7,008,050 | B2 | 3/2006 | Childers et al. |
| 7,025,448 | B2 | 4/2006 | Olsen |
| 7,033,007 | B2 | 4/2006 | Seethoo |
| 7,040,729 | B2 | 5/2006 | Richards |
| 7,070,250 | B2 | 7/2006 | Lester et al. |
| 7,083,273 | B2 | 8/2006 | Silverbrook |
| 7,097,290 | B2 | 8/2006 | Yoshida |
| 7,103,306 | B2 | 9/2006 | Shimizubata |
| 7,104,637 | B1 | 9/2006 | Van Steenkiste |
| 7,118,189 | B2 | 10/2006 | Kuester et al. |
| 7,147,295 | B2 | 12/2006 | Phillips |
| 7,178,900 | B2 | 2/2007 | Blouin et al. |
| 7,212,319 | B2 | 5/2007 | Mercer |
| 7,213,902 | B2 | 5/2007 | DeVivo et al. |
| 7,222,955 | B2 | 5/2007 | Ohashi et al. |
| 7,261,399 | B2 | 8/2007 | Miki |
| 7,306,316 | B2 | 12/2007 | Doak |
| 7,331,664 | B2 | 2/2008 | Langford et al. |
| 7,384,119 | B2 | 6/2008 | Karppinen et al. |
| 7,401,888 | B2 | 7/2008 | Karppinen et al. |
| 7,401,907 | B2 | 7/2008 | Perez |
| 7,455,377 | B2 | 11/2008 | Espasa et al. |
| 7,455,395 | B2 | 11/2008 | Wilson et al. |
| 7,543,923 | B2 | 6/2009 | McNestry |
| 7,576,875 | B2 | 8/2009 | Momose |
| 7,717,549 | B2 | 5/2010 | Rademakers et al. |
| 7,874,636 | B2 | 1/2011 | Perrin et al. |
| 7,918,530 | B2 | 4/2011 | Kanfoush et al. |
| 7,931,359 | B2 | 4/2011 | Esdaile-Watts et al. |
| 7,967,425 | B2 | 6/2011 | Dyer et al. |
| 7,980,683 | B2 | 7/2011 | Bansyo |
| 8,091,860 | B2 | 1/2012 | Thompson et al. |
| 8,100,500 | B2 | 1/2012 | Bansyo |
| 8,128,212 | B2 | 3/2012 | Katada et al. |
| 8,177,344 | B2 | 5/2012 | Asada |
| 8,186,819 | B2 | 5/2012 | Kaiho |
| 8,215,757 | B2 | 7/2012 | Kuribayashi et al. |
| 8,403,467 | B2 | 3/2013 | Asami |
| 8,444,241 | B2 | 5/2013 | Terakado et al. |
| 8,534,807 | B2 | 9/2013 | Hoisington et al. |
| 8,794,747 | B2 | 8/2014 | Enomoto et al. |
| 9,016,843 | B2 | 4/2015 | Nishiyama et al. |
| 2005/0062815 | A1 | 3/2005 | Yoshihira et al. |
| 2005/0099469 | A1 | 5/2005 | Encrenaz et al. |
| 2005/0219281 | A1* | 10/2005 | Seino ..... B41J 2/17523 347/6 |
| 2006/0274130 | A1 | 12/2006 | Self et al. |
| 2008/0099508 | A1 | 5/2008 | Son et al. |
| 2009/0040249 | A1 | 2/2009 | Wouters et al. |
| 2009/0219324 | A1* | 9/2009 | Esdaile-Watts ..... B41J 2/175 347/17 |
| 2010/0039486 | A1* | 2/2010 | Wouters ..... B41J 2/175 347/92 |
| 2010/0283808 | A1* | 11/2010 | Terakado ..... B41J 2/175 347/6 |
| 2011/0007105 | A1* | 1/2011 | Kuribayashi ..... B41J 2/19 347/6 |
| 2011/0279589 | A1 | 11/2011 | Borra et al. |
| 2012/0188314 | A1 | 7/2012 | Akiyama |

FOREIGN PATENT DOCUMENTS

| | | |
|---|---|---|
| EP | 1 167 044 | 1/2002 |
| EP | 1 389 530 | 2/2004 |
| EP | 1 979 168 | 10/2008 |
| GB | 2 280 149 | 1/1995 |
| JP | 62-218139 | 9/1987 |
| JP | 10-324038 | 12/1998 |
| WO | WO 1996/035584 | 11/1996 |
| WO | WO 2007/092489 | 8/2007 |
| WO | WO 2009/005765 | 1/2009 |

OTHER PUBLICATIONS

International Preliminary Report on Patentability of International Application No. PCT/US2007/003239, dated Aug. 14, 2008, Applicant RR Donnelley et al (12 pages).

International Preliminary Report on Patentability of International Application No. PCT/US2008/008114, dated Jan. 5, 2010, Applicant RR Donnelley (7 pages).

International Search Report and Written Opinion of International Application No. PCT/US2008/008114, dated Sep. 8, 2008, Applicant RR Donnelley (8 pages).

Non-final Office Action dated Mar. 25, 2014, for U.S. Appl. No. 13/841,668, Applicant R.R. Donnelley & Sons Company (7 pages).

Supplementary European Search Report for European Application No. EP 07 76 3393, dated Nov. 14, 2008 (9 pages).

International Search Report and Written Opinion of International Application No. PCT/US2017/031750, dated Aug. 14, 2017, Applicant R.R. Donnelley & Sons Company (16 pages).

Communication pursuant to Article 94(3) EPC for Application No. 14 154 508.7, dated Sep. 5, 2017, Applicant R.R. Donnelley & Sons Company (6 pages).

* cited by examiner

464
START
INK CHANNEL ENABLED
466
FILL
452
FILL COMPLETE
STOP MODE
468
OPERATOR SELECTION
456
454
458
RUN
LOCAL RECIRCULATION MODE
RECIRCULATE/ BYPASS
MAIN SUPPLY EMPTY
SHUT DOWN
SUPPLY CHANGE
DRAIN
460
462
END

SYSTEM AND METHOD FOR SUPPLYING INK TO AN INKJET PRINTHEAD

CROSS REFERENCE TO RELATED APPLICATIONS

The present application claims benefit of U.S. Provisional Patent Application No. 62/333,514, filed on May 9, 2016. The entire contents of this application are incorporated herein by reference.

FIELD OF DISCLOSURE

The present subject matter generally relates to inkjet printing systems, and more particularly, to a system and method for supplying ink to one or more inkjet printheads used by such systems.

BACKGROUND

High-speed printing systems typically include one or more imaging units. Each imaging unit has one or more inkjet printheads and a controller controls each inkjet printhead to eject a fluid (such as ink or another composition) onto a receiving surface. Each inkjet printhead includes a nozzle plate that includes a plurality of orifices (nozzles) through which ink from inside the inkjet printhead may be controllably ejected.

An inkjet printhead typically includes a fluid chamber and one or more nozzles. Pressure inside of the fluid chamber is increased relative to ambient air pressure to force a drop of fluid through the nozzle(s). Some inkjet printheads use a piezoelectric element that deforms a wall of the fluid chamber to reduce the volume thereof and thereby increase the pressure within the fluid chamber. Alternately, a heating element may be used to vaporize some of the fluid (or a constituent of the fluid such as a fluid carrier or a solvent) in the fluid chamber to form a bubble therein, which increases the pressure inside the fluid chamber. A controller controls the current that is passed through the piezoelectric element to control the deformation thereof or to control the current through the heating element in turn to control the temperature thereof so that drops are formed when needed. Other types of inkjet technologies known in the art may be used in the printing systems described herein.

In a printing system, an inkjet printhead may be secured to a carrier and disposed such that the nozzles of the inkjet printhead are directed toward the receiving surface. The carrier may be manufactured from steel or other alloys that can be milled to a high precision. More than one inkjet printhead may be secured to the carrier in this fashion in a one or two-dimensional array. To form a printed image, the carrier and a medium to be printed on are moved relative to one another as drops of ink are controllably ejected from the inkjet printhead(s) secured to the carrier. In some systems, the carrier, and therefore the inkjet printhead(s) secured thereto, remains stationary while the medium being printed is moved. In other systems, the medium remains stationary while the carrier is moved. In still other systems, both the carrier and the medium are moved.

Ink is supplied to each inkjet printhead from an ink reservoir via an ink line. If air becomes trapped in the ink line and flows into the fluid chamber of the inkjet printhead during printing, such air may interfere with the proper ejection of ink from the nozzles of the inkjet printhead. Also, some types of ink include particulates suspended in a fluid and such ink must be kept in motion and/or periodically agitated to prevent the particulates from falling out of suspension.

SUMMARY

According to one aspect, an ink supply unit includes a lower ink reservoir, an upper ink reservoir coupled to the lower ink reservoir, and a flow regulation apparatus. First and second fluid input ports are disposed on opposite sides of the flow regulation apparatus. A first fluid line and a second fluid line couple the first and the second input ports, respectively, with the upper ink reservoir. A third fluid line is adapted to couple the flow regulation apparatus with a printhead.

According another aspect, a method of supplying ink includes coupling a lower ink reservoir with an upper ink reservoir, and coupling the upper ink reservoir with first and second input ports of a flow regulation apparatus. The first and second input ports are disposed on opposite sides of the flow regulation apparatus. The method also includes providing a fluid line to couple the flow regulation apparatus with a printhead.

Other aspects and advantages will become apparent upon consideration of the following detailed description and the attached drawings wherein like numerals designate like structures throughout the specification.

DETAILED DESCRIPTION

Figure 1:
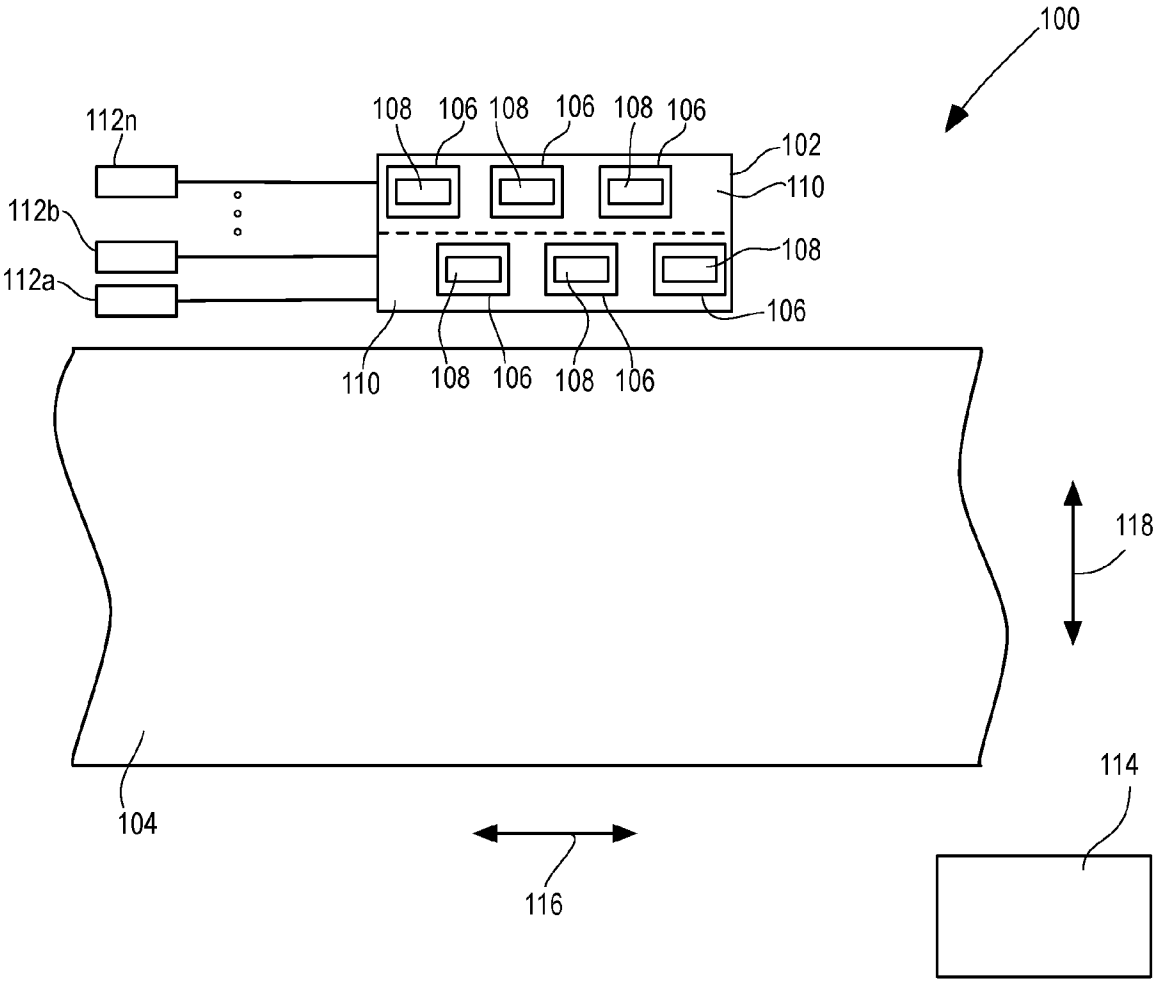
FIG. 1 is a block diagram of a printing system.

Referring to FIG. 1, a printing system 100 includes a print unit 102 arranged to eject ink toward a medium 104. The print unit 102 comprises at least one mount 106 and one or more printheads 108 disposed in each mount 106. The printheads 108 of the print unit 102 may be arranged in one or more rows 110. In some embodiments, each row 110 may have one printhead 108. In other embodiments, each row 110 may have a plurality of printheads 108. In some cases, the one or more printheads 108 may be arranged in a one-dimensional array or a two-dimensional array. Further, in some cases all the rows 110 of the print unit 102 may have an identical number of printheads 108. Alternately, the number of printheads 108 in the rows 110 of the print unit 102 may vary from row to row.

In some embodiments, each printhead 108 of the print unit 102 may print a particular color of ink. As may be apparent to one of skill in the art, the print unit 102 may include, for example, four printheads 108 that print cyan, magenta, yellow, and black ink to form four-color images on the medium 104. The print unit 102 may also include one or more other printheads 108 that print a custom color ink, a white ink, a metallic ink, and/or the like. The medium 104 may be coated or uncoated paper, plastic, polyethylene, a metal, and/or any substrate on which ink or another material ejected by the printhead 108 may be deposited.

The printing system 100 includes one or more ink supply unit(s) 112*a*, 112*b*, . . . , 112*n*. Each ink supply unit 112 is associated with a printhead 108 and supplies ink thereto. Each ink supply unit 112 supplies a particular color or type of ink. In some embodiments, one ink supply unit 112 supplies ink to one printhead 108. In other embodiments, one ink supply unit 112 may supply ink to a plurality of printheads 108. In addition, the printing system 100 includes a controller 114 that coordinates relative movement between the print unit 102 and the medium 104, operation of the printheads 108 to print an image on the medium 104, and operation of the ink supply units 112 to provide ink to the printheads 108. In some embodiments, during printing, the medium 104 may be transported in a direction parallel to a first axis 116 while the print unit 102 is transported in a direction parallel to a second axis 118 perpendicular to the first axis 116. In other embodiments, the print unit 102 may be transported in directions parallel to both the first axis 116 and the second axis 118, while the medium 104 is transported parallel to the first axis 116.

Figure 2A:
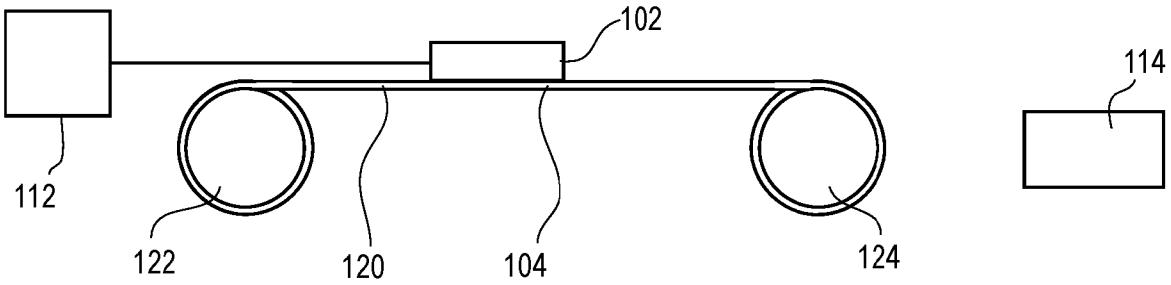
FIGS. 2A and 2B are diagrammatic side elevational views of the printing system of FIG. 1.

Referring to FIG. 2A, in one embodiment, the medium 104 is a web 120 of material to be printed on and supplied from a supply roller 122. In such embodiments, the controller 114 operates one or more motor(s) (not shown) coupled to the supply roller 122 and/or a take up roller 124 to transport the medium 104 past the print unit 102. In another embodiment, the medium 104 may be processed by a finishing station (not shown), which cuts and/or folds the printed web 120 to produce deliverable products. In either embodiment, the controller 114 may control the motor(s) coupled to the supply roller 122 and/or the take up roller 124, and/or may control the finishing station to synchronize movement of the web 120 with operation of the print unit 102.

Figure 2B:
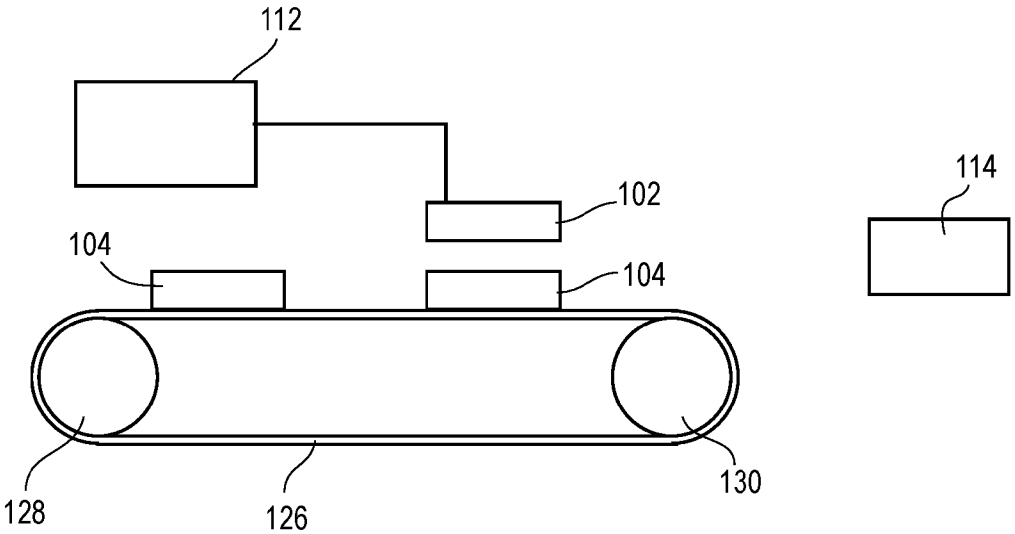

Referring to FIG. 2B, in yet another embodiment, the medium 104 is placed on a carrier 126, and the carrier 126 and the medium 104 together are transported relative to the print unit 102. The carrier 126 may be, for example, a belt driven by rollers 128 and 130. The controller 114 may control one or more motor(s) (not shown) coupled to the rollers 128 and 130 to synchronize the movement of the carrier 126 with the operation of the print unit 102.

Figure 3:
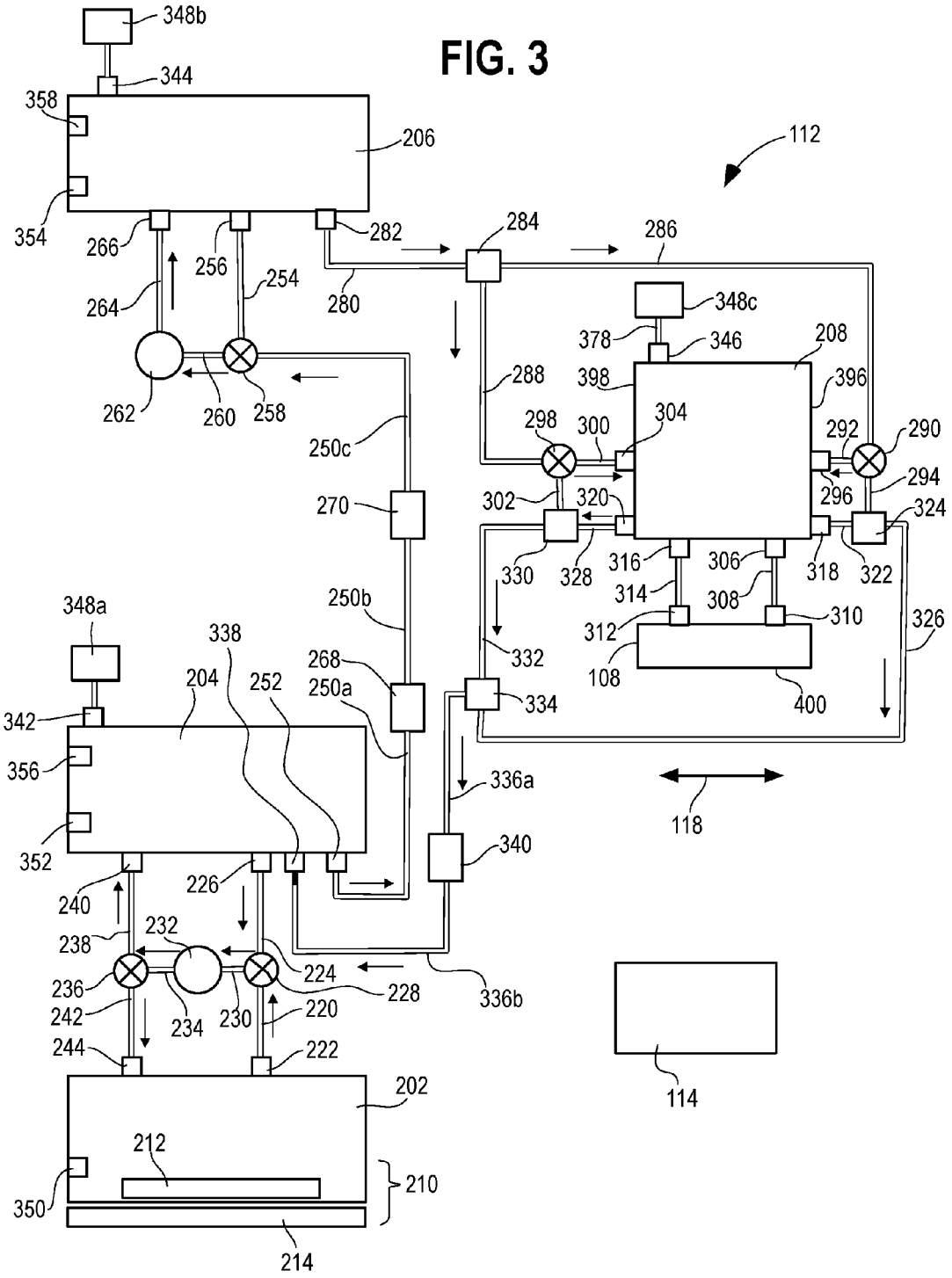
FIG. 3 is a block diagram of an ink supply unit of the printing system of FIG. 1.

Referring to FIG. 3, the ink supply unit 112 may be coupled to a main ink supply 202 to supply ink to the printhead 108. The ink supply unit 112 includes a lower ink reservoir 204, an upper ink reservoir 206, and a flow regulation apparatus 208.

In one embodiment, if the type of ink the main ink supply 202 is prone to settling or stagnation if such ink is not kept in motion, the main ink supply 202 may be coupled to an ink agitation apparatus 210. In one embodiment, the ink agitation apparatus 210 includes a stirring magnet 212 and a stirrer plate 214. The stirring magnet 212 is disposed in the main ink supply 202, and the main ink supply 202 is disposed on top of a stirrer plate 214. The controller 114 actuates the stirrer plate 214 to spin or agitate the stirring magnet 212, and such spinning or agitation of the stirring magnet agitates the ink in the main ink supply 202.

As described in detail below, the controller 114 operates valves and pumps of the ink supply unit 112 to provide ink on demand to the printhead 108. Further, when the printhead 108 does not require ink, the controller operates such valves and pumps to keep the ink substantially constantly in motion between the ink supply unit 112 and the printhead 108, or among the main ink supply 202, the lower ink reservoir 204, the upper ink reservoir 206 and the flow regulation apparatus 208. Keeping the ink in motion preserves a relatively even distribution of components, for example, pigment particles, in the ink, and prevents separation and/or settling of such components.

Referring once again to FIG. 3, a fluid line 220 is coupled to an output port 222 of the main ink supply 202. A fluid line 224 is coupled to an output port 226 of the lower ink reservoir 204. A three-way valve 228 is coupled to the fluid lines 220 and 224 and a fluid line 230. The controller 114 operates the three-way valve 228 to fluidically couple one of the fluid lines 220 and 224 to the fluid line 230. The fluid line 230 is coupled to a pump 232, which when actuated by the controller 114 draws fluid from the fluid line 230 into a fluid line 234. A three-way valve 236 is coupled to the fluid line 234, a fluid line 238 coupled to an input port 240 of the lower reservoir 204, and a fluid line 242 coupled to an input port 244 of the main ink supply 202. The controller 114 operates the three-way valve 236 to fluidically couple the fluid line 234 to one of the fluid lines 238 and 242.

A fluid line 250 is coupled to an output port 252 of the lower ink reservoir 204 and a fluid line 254 is coupled to an output port 256 of the upper ink reservoir 206. A three-way valve 258 is coupled to the fluid lines 250, 254, and 260. The controller 114 operates the three-way valve 258 to fluidically couple one of the fluid lines 250 and 254 to the fluid line 260. A pump 262 is coupled to the fluid line 260 and may be actuated by the controller 114 to draw ink from the fluid line 260 into a fluid line 264. The fluid line 264 is coupled to an input port 266 of the upper ink reservoir 206.

In some embodiments, a filter 268 and/or a degasser 270 may be disposed along the fluid line 250. The filter 268 may remove any impurities or contaminants in the ink. The degasser 270 removes any air bubbles that may be in the ink.

A fluid line 280 couples an output port 282 of the upper reservoir 206 and a t-connector 284. The t-connector 284 fluidically couples the fluid line 280 to fluid lines 286 and 288. The fluid line 286 is coupled to a three-way valve 290 that is operated by the controller 114 to fluidically couple the fluid line 286 to one of fluid lines 292 and 294. The fluid line 292 is coupled to an input port 296 of the flow regulation apparatus 208.

Similarly, the fluid line 288 is coupled to a three-way valve 298 that when operated by the controller 114 fluidically couples the fluid line 288 to one of a fluid line 300 and a fluid line 302. The fluid line 300 is coupled to an input port 304 of the flow regulation apparatus 208.

As is described in greater detail below, the flow regulation apparatus 208 fluidically couples the fluid lines 292 and 300 to the printhead 108 via an output port 306 and a fluid line 308. The fluid line 308 couples the output port 306 and an input port 310 of the printhead 108. An output port 312 of the print head 108 is coupled to a fluid line 314, and the fluid line 314 is coupled to an input port 316 of the flow regulation apparatus 208. The flow regulation apparatus 208 couples the input port 316 to output ports 318 and 320 thereof.

The output port 318 is coupled to a fluid line 322, which is coupled to a t-connector 324. The t-connector 324 fluidically couples the fluid lines 322 and 294 to a fluid line 326. Similarly, the output port 320 is coupled to a fluid line 328, which is coupled to a t-connector 330. The t-connector 330 fluidically couples both of the fluid lines 302 and 328 to a fluid line 332.

Both of the fluid lines 326 and 332 are fluidically coupled by a t-connector 334 to a fluid line 336. The fluid line 336 is coupled to an input port 338 of the lower ink reservoir 204. In some embodiments, an ink-cooling device 340 may be disposed along the fluid line 336 to cool the ink flowing through such fluid line to a predetermined temperature.

The lower reservoir 204, the upper reservoir 206, and the flow regulation apparatus 208 include ports 342, 344, and 346, respectively, each of which is coupled to a pressure control apparatus 348*a*, 348*b*, and 348*c*, respectively. The pressure control apparatus 348 may be operated by the controller 114 to introduce pressurized air though one or more of the ports 342, 344, and 346; apply a vacuum (i.e., negative pressure) to one or more of the ports 342, 344, and 346; or vent one or more of the ports 342, 344, and 346 to the atmosphere surrounding ink supply unit 112.

Each pressure control apparatus 348*a*, 348*b*, and 348*c* includes an active pressure controller such as, for example, Alicat Model Number PCDS-5PSIG-D-10, manufactured by Alicat Scientific, Inc. of Tucson, Ariz. Such pressure controller operates vacuum and pressurized air sources to maintain a particular pressure level specified by the controller 114 in the lower reservoir 204, the upper reservoir 206, and the flow regulation apparatus 208. The pressure control apparatus 348 also includes one or more valves operated by the controller 114 that couples the lower reservoir 204, the upper reservoir 206 and the flow regulation apparatus 208 to either the pressure controller or a vent into the ambient environment where the ink supply unit 102 is disposed. In one embodiment, the pressure control apparatuses 384*a* and 348*b* are implemented using one active pressure controller. That is one vacuum source or pressurized air source is shared between the two apparatuses 384*a* and 384*b*, and is controlled by one active pressure controller. Further, in such embodiments, one pressure control apparatus 348*c* is implemented using an active pressure controller different from that used to implement the pressure control apparatuses 384*a* and 348*b*.

Referring also to FIG. 1, in some embodiments, the pressure control apparatus 348*c* associated with the fluid control apparatuses of all of ink supplies 112*a*, 112*b*, . . . 112*c* of the printing system 100 is implemented using one active pressure controller.

The main ink supply 202, lower ink reservoir 204, and upper ink reservoir 206 include low ink level sensors 350, 352, and 354, respectively. In addition, the lower ink reservoir 204 and the upper ink reservoir 206 include high ink level sensors 356 and 358, respectively. The operation of these sensors 350, 352, and 354 is described in detail below.

Figure 4:
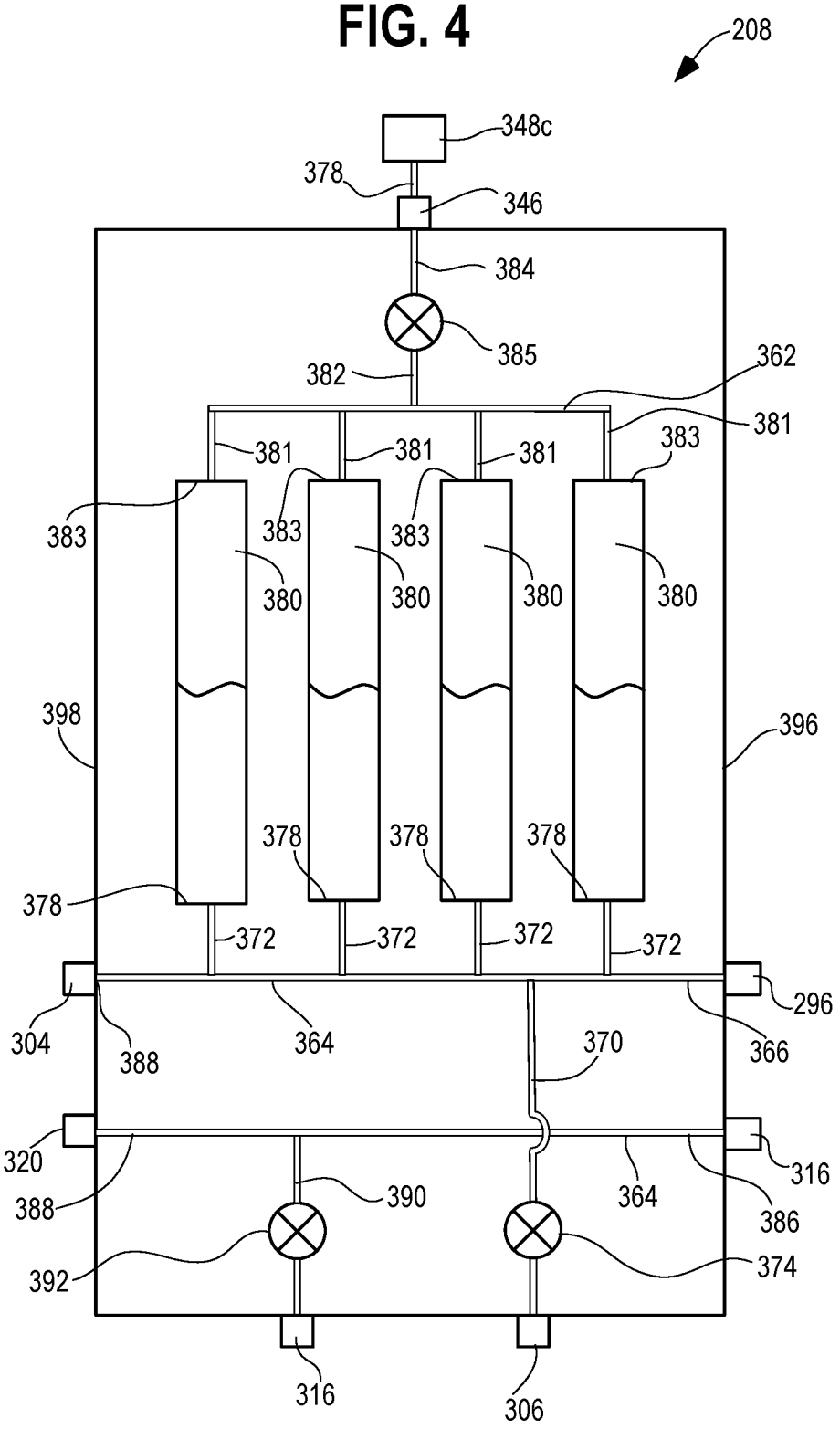
FIG. 4 is a block diagram of a flow regulation apparatus of the ink supply unit of FIG. 3.

Referring to FIG. 4, the flow regulation apparatus 208 includes manifolds 360, 362, and 364. One end 366 of the manifold 360 is fluidically coupled to the input port 296 and another end 368 is fluidically coupled to the input port 304. The manifold 360 includes an output line 370 extending toward the printhead 108, and one or more output lines 372 extending away from the print head 108. A two-way valve 374 fluidically couples the output line 370 to a fluid line 376. The fluid line 376 is coupled to the output port 306 of flow regulation apparatus 208 that leads to the input port 310 (see FIG. 3) of the printhead 108. Each output line 372 of the manifold 360 is coupled to a bottom portion 378 of a corresponding standpipe, chimney, or tube 380 extending upwardly away from the printhead 108.

The manifold 362 includes a fluid line 381 associated with each standpipe 380 and a fluid line 382. Each fluid line 381 is coupled to a top portion 383 of the standpipe 380 associated therewith. The fluid line 382 is coupled to a fluid line 384 via a two-way valve 385, and the fluid line 384 is coupled to the port 346, which is coupled to the pressure control apparatus 348*c* via the fluid line 378.

In some embodiments, the controller 114 opens the two-way valve 385 to couple the fluid line 382 to the fluid 384 and operates the pressure regulation apparatus 348*c* to increase or decrease the pressure in the standpipes 380. In such embodiments, the controller 114 closes the two-way valve 385 to isolate the standpipes 380 from the pressure regulation apparatus 348*c* when such pressure regulation is not necessary.

The manifold 364 includes ends 386 and 388 coupled to output ports 318 and 320, respectively, of the flow regulation apparatus 208, and a line 390 coupled to a two-way valve 392. The valve 392 fluidically couples the line 390 to a line 394 that is coupled to the port 316, and thereby to the output port 312 of the printhead 108 (see FIG. 3).

The flow regulation apparatus 208 is disposed above the printhead 108 and moves in tandem with the printhead 108 in directions parallel to the axes 116 and/or 118 (see FIG. 1). The flow regulation apparatus 208 mitigates the changes in ink pressure that acceleration of the flow regulation apparatus 208 and printhead 108, may induce in the lower reservoir 204, upper reservoir 206, the fluid lines 280 and 336 that connect these reservoirs to the flow regulation apparatus 208, and the printhead 108.

In particular, as shown in FIGS. 3 and 4, the ports 296 and 304 are disposed on opposite sides 396 and 398 of the flow regulation apparatus 208, and these ports are separated along a direction of movement of the flow regulation apparatus 208, for example, the axis 116 or 118. If the printhead 108 and the flow regulation apparatus 208 accelerate in a manner that increases ink pressure in the fluid lines 286 and 292 coupled to the port 296, then such acceleration will cause a corresponding decrease in ink pressure in the fluid lines 288 and 300 coupled to the port 304. Similarly, an increase in ink pressure in the fluid lines 288 and 300 caused by acceleration of the printhead 108 and the flow regulation apparatus 208 would be accompanied by a corresponding decrease in ink pressure in the fluid lines 286 and 292. Such ink pressure changes would not be induced in the fluid line 280, and therefore the upper ink reservoir 206, coupled to the fluid lines 286 and 288 because the increase in ink pressure in the fluid lines 286 and 292 (or 288 and 300) would be substantially counteracted by a corresponding decrease in ink pressure in the fluid lines 288 and 300 (or 286 and 292).

For similar reasons, the ports 318 and 320 are disposed on the opposite sides 396 and 398 of the flow regulation apparatus 208. An ink pressure increase (decrease) in the fluid lines 322 and 326 coupled to the port 318 due to acceleration of the printhead 108 and the flow regulation apparatus 208 would be accompanied by a corresponding pressure decrease (increase) in the fluid lines 328 and 332. Thus, transmission of such ink pressure changes to the fluid line 336 and the lower reservoir 338 due to ink pressure changes in the fluid lines 322, 326, 328, and 332 would be mitigated.

In one embodiment, the sides 396 and 398 are separated in a direction identical to that of one of the axes 116 or 118 along which the printhead 108 experiences the greatest acceleration during operation. In the absence of the flow regulation apparatus 208, rapid acceleration of the printhead 108 along such axis may generate more pressure changes in the ink supply 112 than that generated by the lower acceleration along the other axis.

The one or more standpipes 380 of the flow regulation apparatus 208 reduce the effects of pressure changes in the manifold 360 due to acceleration of the printhead 108 (and the flow regulation apparatus 208) in the fluid lines 370 and 376, and therefore in the printhead 108. In particular, if the pressure in the fluid line 362 increases, such increase will cause ink to flow into the one or more standpipes 380 rather than into the fluid line 370. Similarly, a decrease in pressure in the fluid line 362 will cause ink to flow out of the one or more standpipes 380 to compensate for such decrease in the pressure.

Referring once again to FIG. 3, in some embodiments, the upper reservoir 206 is disposed so that entire upper reservoir 206 is further away from the ground than a nozzle plate 400 of the printhead 108. In other embodiments, the uppers reservoir 206 is disposed so that the minimum level of ink in such reservoir is always above the nozzle plate 400 of the printhead 108. Further, the lower reservoir 204 is disposed so that the entire lower reservoir, or at least the maximum ink level in the upper reservoir 206, is closer to the ground than the nozzle plate 400 of the printhead 108. In this configuration of the upper reservoir 206, the printhead 108 and the lower reservoir 204, ink in the upper reservoir 206 drains into the lower reservoir 204 substantially because of gravity whenever a fluid path exists therebetween. Further, if the printhead 108 is in the fluid path between the upper reservoir 206 and the lower reservoir 204, the ink will drain from the upper reservoir 206, through the printhead 108, and into the lower reservoir 204.

Figure 5:
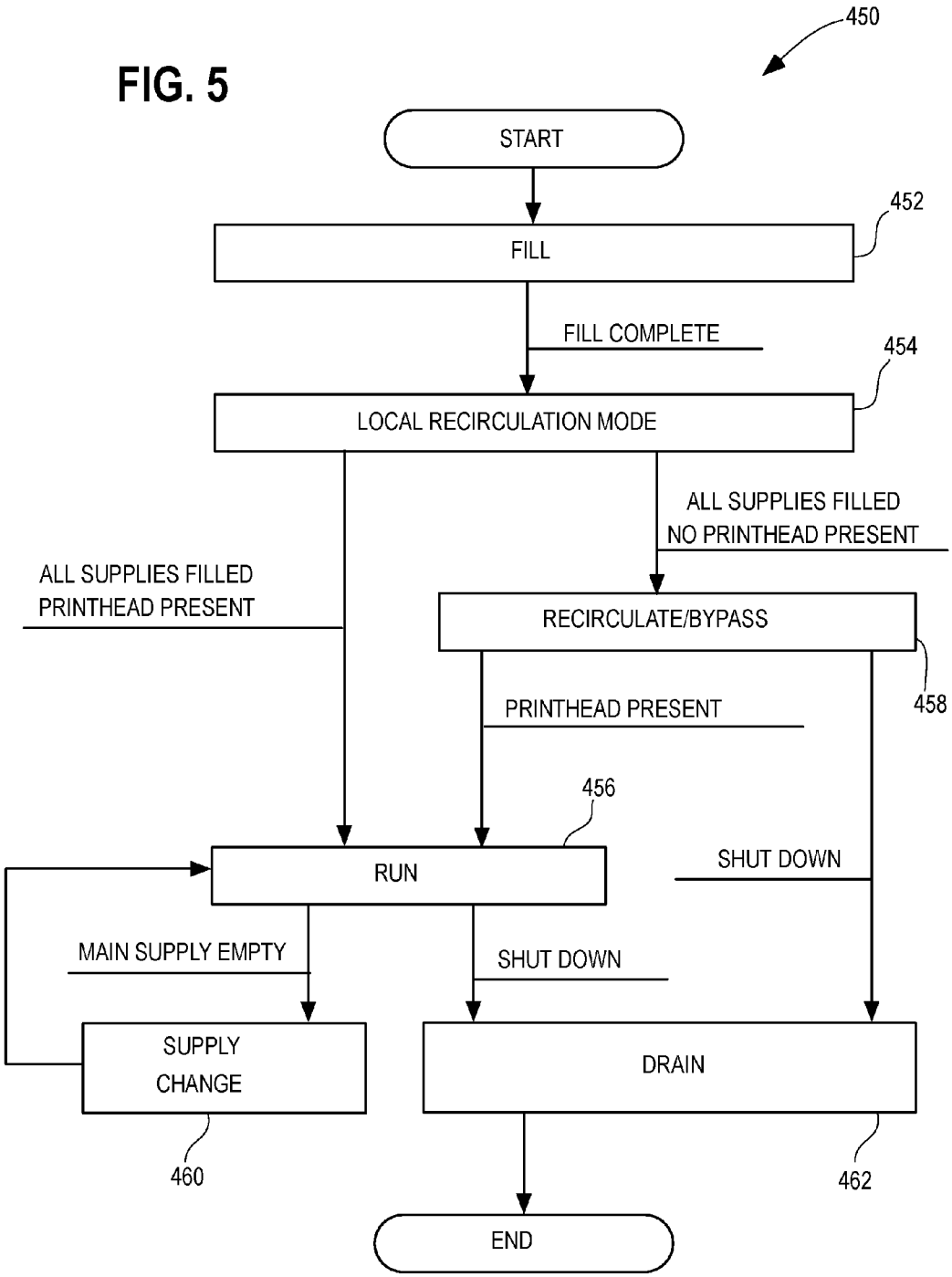
FIG. 5 is a state diagram that illustrates operating modes of the ink supply unit of FIG. 3.

FIG. 5 is a state diagram 450 that illustrates the operating modes of the ink supply unit 112. Referring to FIGS. 3 and 5, initially the ink supply unit 112 operates in a fill mode 452 during which a main ink supply 202 is coupled to the ink supply unit 112, and the lower ink reservoir 204 and the upper ink reservoir 206 are filled with a portion of the ink from the main ink supply 202. In particular, an operator verifies that the main ink supply 202 has ink and that the fluid lines 220 and 242 are coupled to the ports 222 and 244, respectively, of the main ink supply 202 and directs the controller 114 to initiate the fill mode 452.

The controller 114 sets the three-way valve 228 to fluidically couple the fluid line 220 to the fluid line 230 and the three-way valve 236 to fluidically couple the fluid line 234 to the fluid line 238. The controller 114 also sets the three-way valve 258 to fluidically couple the fluid line 254 to the fluid line 260.

Then, the controller 114 actuates the pump 232 and the pump 262. The pump 232 causes ink to be drawn from the main ink supply 202, through the port 222, the fluid line 220, the valve 228, the fluid line 230, the pump 232, the fluid line 234, the valve 236, the fluid line 238, the port 240, and into the lower ink reservoir 204.

In some embodiments, the pumps 232 and 262 are pumps of a two-channel diaphragm pump. In such embodiments, the fluid lines 234 and 238 are coupled to one channel and the fluid lines 260 and 264 are coupled to another channel. In such embodiments, while the lower ink reservoir 204 is being filled with ink, the pump 262 draws air from the upper ink reservoir 206, through the port 256, the fluid line 254, the three-way valve 258, the fluid line 260, the pump 262, the fluid line 264, the port 266, and returns the drawn air into the lower reservoir 204. Such recirculation of air prevents drawing ink and air into the pump 262, which could create a foam of ink and air. Such foam would interfere with the operation of the level sensors 352 and 354 and compromise operation of the ink system 112.

Ink is drawn from the main ink supply 202 into the lower ink reservoir 204 in this manner until the ink level is above the low ink level sensor 352. Thereafter, the controller 114 operates the valve 228 to fluidically couple the fluid line 224 to the fluid line 230 so the ink in the lower reservoir recirculates through the fluid lines 224, 230, 234, and 238. Concurrently, the controller 114 sets the valve 258 to fluidically couple the fluid line 250 to the fluid line 260, causing ink to flow from the lower ink reservoir 204, through the fluid line 250 through the filter 268 and degasser 270, the three-way valve 258, the fluid line 260, the pump 262, the fluid line 264, the port 266, and into the upper ink reservoir 206.

The ink flows from the lower reservoir 204 to the upper reservoir 206 in this manner until the level of the ink in the lower reservoir 204 is below the low ink level sensor 352. Then the controller 114 operates the valve 228 to fluidically couple the fluid line 220 and the fluid line 230 to draw more ink from the main ink supply 202 into the lower ink reservoir 204. Concurrently, the controller 114 operates the valve 258 to fluidically couple the fluid line 254 with the fluid line 260 to recirculate the ink in the upper ink reservoir 206. The controller 114 operates the valves 228 and 258 in this manner to alternate between drawing ink from the main ink supply 202 into the lower ink reservoir 204 and drawing ink from the lower ink reservoir 204 into the upper ink reservoir 206 until the ink levels in both the lower ink reservoir 204 and the upper ink reservoir 206 are above the low ink level sensors 342 and 354, respectively. In some embodiments, the controller 114 operates the pumps 232 and 262, and the valves 228 and 258 for a predetermined amount of time after ink levels in both the lower ink reservoir 204 and the upper ink reservoir 206 reach the low ink level sensors 342 and 354, respectively. Such additional operation, draws more ink to the reservoirs 204 and 206 and prevents cycling the pumps 232 and 262, and the valves 228 and 258, due to hysteresis.

Thereafter, the controller 114 operates the valve 228 to fluidically couple the fluid line 224 with the fluid line 230 to recirculate the ink in the lower ink reservoir 204, and the three-way valve 258 to fluidically couple the fluid line 254 with the fluid line 260 to recirculate the ink in the upper ink reservoir 206.

In some embodiments, the controller 114 actuates the pump 232 (and not the pump 262) until the level of the ink in the lower ink reservoir 204*a* is at least at the level of the ink level sensor 352 and then actuates the pump 262 to fill the upper ink reservoir 206.

Referring to FIG. 5, in some embodiments, the ink supply unit 112 transitions into run mode 456 or the recirculate/bypass mode 458 described below. In other embodiments, the ink supply unit 112 operates in a local recirculation mode 454 during which ink recirculates in each of the lower ink reservoir 204 and the upper ink reservoir 206. In other embodiments, during the local recirculation mode 454, the controller turns off the pumps 232 and 262, regulates vacuum in the lower reservoir 204 and the upper reservoir 206, and closes the valves 258, 228, and 236. In some embodiments, the controller 114 operates the pressure control device 348 to maintain a vacuum between approximately 1 inch and approximately 6 inches of water (between approximately 249 Pascal and 1,500 Pascal) in the lower reservoir 204 and the upper reservoir 206. The amount of vacuum may be selected depending on the type of printhead 108 and the type of ink being used.

In one embodiment, the sensors 352, 356, 354, and 358 are capacitive level sensors such as those manufactured by, for example, Turck, Inc. of Minneapolis, Minn.

The ink supply unit 112 operates in the local recirculation mode 454 until upper and lower reservoirs 204 and 206 of all of ink supply units 112*a*, 112*b*, . . . , and 112*n* (see FIG. 1) of the printing system 100 have been filled so that such upper and lower reservoirs 204 and 206 have ink therein above the low ink sensors 352 and 354 thereof, respectively, and all of ink supply units 112*a*, 112*b*, . . . , and 112*n* of the printing system are operating in the local recirculation mode 454. In some embodiments, the reservoirs of the ink supply units 112*a*, 112*b*, . . . , and 112*n* are filled simultaneously and such local recirculation mode 454 may not be necessary.

After the upper and lower reservoirs 204 and 206 of all of the ink supply units 112 are filled, the operator may couple the printhead 108 to the flow regulation apparatus 208 (if such printhead 108 has not already been coupled) and direct the control system 114 to operate the ink supply unit 112 in a run mode 456 during which the printing system 100 may be used to print on the medium 104. Alternately, if the printing system 100 is not ready to be used for printing, the operator may direct the control system 114 to operate the ink supply unit 112 in a recirculate/bypass mode 458 during which the ink in the ink supply unit 112 is recirculated and/or agitated to keep it from settling. If the printing system 100 is not going to be used for a long period of time, the operator may direct the controller 114 to close the valves 392 and 394 and remove the printhead 108 for cleaning and storage.

Figure 5A:
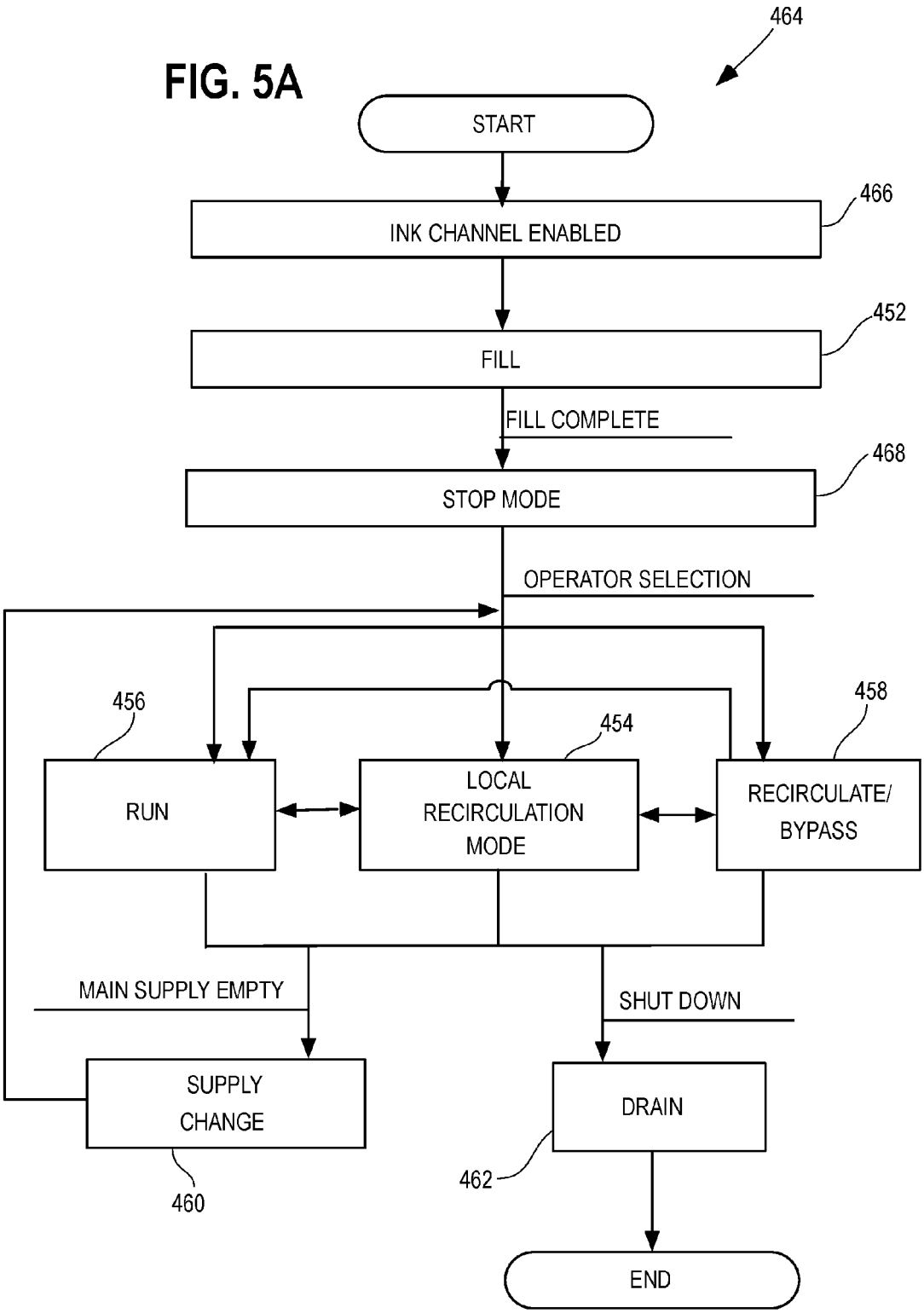
FIG. 5A is a state diagram that illustrates operating modes in another embodiment of the ink supply unit of FIG. 3.

FIG. 5A is a state diagram of 464 that illustrates the operating modes of another embodiment of the ink supply unit 112. Referring to FIGS. 3, 5, and 5A, the operator activates the ink supply unit 112 associated with a particular color or type of ink (i.e., ink channel) and the ink supply unit 112 operates in an ink channel enabled mode 466. During the ink channel enabled mode 466, the controller 114 initializes the components and sensors used in the ink supply and then transitions the ink supply unit 112 to the fill mode 452 described above. After the lower ink reservoir 204 and the upper ink reservoir 206 are filled as described above, the controller 114 transitions the ink supply unit 112 into a stop mode 468. In the stop mode 468, the controller 114 waits for the operator to select one of the run mode 456, local recirculation mode 454, and the recirculate/bypass mode 458 described above.

For example, the operator may select the run mode 456 if the printhead 108 is coupled to ink supply unit 112 and the printing system 100 is to be used to print. Alternately, for example, the operator may select the recirculate/bypass mode 454 if no printhead is connected and/or other components of the printing system 100 are being readied for printing. Further, the operator may select, for example, local recirculation mode 454 to keep the ink in the lower and upper ink reservoirs 204 agitated during a period when the system is not going to be used for a period of time.

In addition, the operator may direct the controller 114 to transition the ink supply unit 112 from operating in one of the run mode 456, local recirculation mode 454, and recirculate/bypass mode 458 to another one of these modes. The operator may also direct the controller 114 to transition the ink supply unit 112 from operating in one of the run mode 456, local recirculation mode 454, and recirculate/bypass mode 458 to the drain mode 462 to begin shutdown of the ink supply unit. Further, the ink supply may transition, either automatically or upon direction from the operator, from one of the run mode 456, local recirculation mode 454, and recirculate/bypass mode 458 to the supply change 460 mode if the ink in the main ink supply 202 is depleted.

The ink supply unit 112 associated with each ink channel of the printing system 100 operates independently of ink supply units 112 associated with other ink channels. The operator may monitor the ink supply units 112 associated with different ink channels until all such ink supply units 112 are operating in the stop mode 468, for example, and then transition each such ink supply unit 112 to the run mode 456 to commence printing.

In some embodiments, the controller 114 operates the pressure control devices 348*a* and 348*b* to apply negative pressure and maintain the vacuum in the lower reservoir 204 and the upper reservoir 206 at all times when the ink supply 112 is active, i.e., when the ink supply 112 is in one of the local recirculation mode 454, run mode 456, stop mode 468, and recirculation bypass mode 458.

Referring to FIGS. 3-5, when the run mode 456 is initiated, the controller undertakes a series of bypass purge cycles to purge air from the fluid lines 280, 286 and 288, and the fluid pathways of the flow regulation apparatus 208 and replace such air with ink. In particular, the controller 114 operates the valve 290 to fluidically couple the fluid line 286 with the fluid line 292, closes the valve 298 to decouple the fluid line 288 from the fluid lines 300 and 302 (if such valve is not already closed), and closes the valves 374 and 392 of the flow regulation apparatus 208 (if these valves are open) to decouple the printhead 108 from the ink supply unit 112. The controller 114 operates the pressure control apparatus 348*c* to vent the fluid line 378. Alternately, the controller 114 may operate the pressure control apparatus 348*c* to apply a negative pressure (i.e., a vacuum) to the fluid line 378. Thereafter, controller 114 operates the pressure control apparatus 348*b* to cycle between increasing the pressure in the upper reservoir 206 for a first predetermined amount of time and releasing the pressure in the upper reservoir 206 for a second predetermined amount of time. In some embodiments, the controller 114 operates the pressure control apparatus 348*b* in this manner for between three and four cycles and the first predetermined amount of time is approximately eight seconds.

During each purge cycle the controller 114 generates a burst of pressure to forcibly replace any air in the fluid lines 280, 286 and 292, and the manifold 360 with ink from the upper reservoir 206. Such bursts of pressure also force ink into the standpipes 380. For example, in one embodiment each standpipe 380 is approximately ten inches long, and bursts of pressure are used to force enough ink into the standpipe 380 so that the height of the ink in the standpipe 380 is between approximately four and five inches of ink. In some embodiments, the controller 114 may direct the operator to visually confirm that sufficient ink is present in each standpipe 380. In other embodiments, the controller 114 may query a sensor (not shown) disposed in the standpipe 380 to determine if sufficient ink is in the standpipe 380.

In some embodiments, the controller 114 undertakes one or more purge cycles first to replace air with ink in the lines 286, 288, 294, 304, 326, 332, and 336 without the pressure control apparatus 208 being in the fluid path between the lines 280 and 336. In particular, the controller 114 operates the valve 298 to couple the fluid line 288 with the fluid lines 302 and 332, and the valve 290 to couple the fluid line 286 with the fluid lines 294 and 326. The controller 114 then operates the pressure regulation device 348*b* to force ink from the upper reservoir 206 through the lines 286, 288, 294 304, 326, 332, and 336 and into the lower reservoir 204, and thereby forcibly replace any air in such lines with ink.

Thereafter, the controller 114 operates the valve 290 to couple the fluid line 286 with the fluid line 292 and the valve 298 to couple the fluid line 288 with the fluid line 300 to introduce the pressure control apparatus 208 into the fluid path, which causes ink to flow through the fluid control apparatus 208. The controller 114 then operates the valve 385 to couple manifold 362 to the pressure regulation device 348*c* and operates the pressure regulation device 348*c* at a predetermined negative pressure greater than the predetermined negative pressure applied by the pressure regulation device 348*b* to the upper reservoir 206. Such negative pressure application by the pressure regulation device 348*c* draws ink into the standpipes 380. The predetermined negative pressure applied by the pressure regulation device 348*c* is selected so that the level of ink in the standpipes 380 reaches approximately half the length of each standpipe 380. In some embodiments, an auxiliary fluid sensor (not shown) may be disposed in each standpipe 380 at approximately half the length of each standpipe 380, and the controller 114 closes the valve 385 when the level of ink in each standpipe 380 reaches such auxiliary fluid sensor. In some embodiments, the standpipes 380 may be manufactured from a transparent material or include a transparent window, and an operator may direct the controller to turn the valve 385 on or off to control the level of the ink in the standpipe.

In some embodiments, when the ink supply 112 is operated in the run mode 456, the controller 114 keeps the valve 385 open and actively regulates pressure applied by the pressure regulation device to maintain ink in the standpipes 380. In other embodiments, the controller 114 closes the valve 385 while the ink supply 112 is operated in the run mode 456. In such embodiments, the controller 114 opens the valve 385 only as necessary if the ink in the stand pipe 380 falls below a predetermined level, as detected by the auxiliary sensor described above or when directed by an operator.

In some embodiments, each standpipe has an interior diameter of approximately 0.375 inches (approximately 0.9525 centimeters). Also, in some embodiments, the standpipe 380 is manufactured from clear tubing, preferably of a material to which ink does not adhere. Such standpipe 380 may be exposed so that an operator can easily determine the level of ink in the standpipe 380.

After the fluid lines 280, 286, and 292 have been primed with ink, the controller 114 closes the valve 290 to decouple the fluid line 286 from the fluid line 292, and operates the valve 298 to fluidically couple the fluid line 288 with the fluid line 300. The controller 114 once again cycles the pressure control apparatus 348*b* as described above to generate bursts of pressure in the upper reservoir 206 to force ink into the fluid lines 288 and 300.

After the fluid lines 282, 286, 288, 292 and 300, the manifold 360, and the standpipe(s) 380 are filled with ink, the controller 114 operates the valve 374 (see FIG. 4) to fluidically couple the fluid line 370 with the fluid line 376, and thereby couple the fluid line 308 leading to the printhead 108 with the fluid line 370. The controller 114 also operates the three-way valve 392 to fluidically couple to fluid line 390 with the fluid line 394, and thereby couple the fluid line 314 from the printhead 108 with the fluid line 390.

The controller 114 also operates the valves 290 and 298 to couple the fluid lines 286 and 288, respectively to the flow regulation apparatus 208.

Thereafter, while operating in the run mode 456, gravity causes ink from the upper reservoir 206 through the fluid lines 280, 286, 288, 292 and 300 into the manifold 360, from the manifold 360 into the printhead 108 via the fluid lines 370, 376 and 308, and from the printhead 108 into the lower reservoir 204 via the fluid lines 314, 328, 332, and 336.

To print an image on the print medium 102, the controller 114 transports the print medium 102 relative to the printhead 108 as described above, receives data representing an image to be printed, and operates the printhead 108 to controllably eject drops of ink from nozzles disposed in the nozzle plate 400 of the printhead 108 onto the print medium 102 to print the image thereon. Such ejection of ink from the printhead 108 may cause additional ink to be drawn from the upper reservoir 206.

While the ink supply unit 112 is operating in the run mode 456, the controller 114 operates the pressure control apparatuses 348*a* and 348*b* to supply an identical amount of negative pressure to the lower ink reservoir 204 and the upper ink reservoir 206. Such negative pressure prevents ink from weeping out of the nozzles nozzle plate 400 of the printhead 108 when the printhead 108 is not ejecting ink. In one embodiment, the controller 114 operates the pressure control apparatuses 348 and 348*b* to apply a negative pressure of approximately 1 inch and approximately 6 inches of water (between approximately 249 Pascal and 1,500 Pascal).

In addition, the controller 114 operates the pressure control apparatus 348*c* to supply sufficient negative pressure through the port 346 of the flow regulation apparatus 208 to maintain a fluid height in the standpipe that is equal to the sum of the height of the ink in the upper reservoir 206 and the difference in pressure between the upper reservoir 206 and the pressure in the standpipe 380. For example, if the fluid level of in the upper reservoir 206 is at the same height as the base of the standpipe 380, the negative pressure in the upper reservoir 206 is maintained at 3 inches (7.62 centimeters) of ink, and each standpipe 380 is maintained at 10 inches (25.4 centimeters) of ink, then the fluid level in the standpipe 208 will be at 7 inches (7.78 centimeters).

If draining and/or ejection of the ink described above reduces the ink level in the upper reservoir 206 to be below the low ink level sensor 354, the controller operates the three-way valve 258 to fluidically couple the fluid line 250 with the fluid line 260 so that the pump 262 draws ink from the lower reservoir 204, through the fluid line 250 (and the filter 268 and degasser 270 disposed along the fluid line 250), the valve 258, the fluid line 260, the pump 262, the fluid line 264, into the upper reservoir 206. When sufficient ink has been drawn from the lower reservoir 204 into the upper reservoir 206 so that the level of the ink in the upper reservoir 206 is above the low ink level sensor 354, the controller 114 operates the valve 258 to fluidically couple the fluid line 254 with the fluid line 260 so that the pump 262 stops drawing ink from the lower ink reservoir 204 and, instead, recirculates the ink in the upper ink reservoir 206.

When operating in the run mode 456, if the level of the ink in the lower reservoir 204 falls below the low ink level sensor 352, the controller 114 operates the three-way valve 228 to fluidically couple the fluid line 220 with the fluid line 230 so that the pump 232 draws ink from the main ink supply 202 into the lower ink reservoir 204 via the fluid lines 220, 230, 234 and 238. Once the level of the ink in the lower reservoir is above the low ink sensor 352, the controller 114 operates the three-way valve 228 to fluidically couple the fluid line 224 with the fluid line 230 to recirculate the ink in the lower ink reservoir 204.

During the run mode 456, the controller 114 recirculates ink in the fluid lines 224, 230, 234, 242 and 220, and the pump 232. In particular, the controller 114 operates the valve 228 to couple the fluid line 224 to the fluid line 230 and the valve 238 to couple the fluid line 234 to the fluid 242. Thereafter, the controller 114 operates the pump 232 to draw ink from the lower reservoir 204 into the main ink supply 202. The ink is drawn in this manner until the level of the ink in the lower reservoir reaches the low ink sensor 352. Then, the controller 114 operates the valve 228 to couple the line 220 to the line 230, the valve 236 to couple the line 234 to the line 238, and the pump 232 to draw ink from the main ink supply 202 into the lower reservoir 204. The ink is transferred from the main ink supply 202 into the lower reservoir 204 until the level of the ink in the lower reservoir 204 reaches the level of the low ink sensor 352, and for a predetermined amount of time thereafter so that the ink level is above such sensor 352. Thereafter, the controller 114 again operates the valves 228 and 236 to draw ink from the lower reservoir 204 into the main ink supply 202. The controller 114 causes such movement between the main ink supply 202 and the lower reservoir 204 to prevent ink in the fluid lines 224, 230, 234, 252, and 220 from becoming stagnant during periods when a substantial amount of ink is not being used for printing.

In one embodiment, if the level of the ink in the main ink supply 202 falls below a level associated with the low ink sensor 350, the controller 114 operates the ink supply unit 112 in a supply change mode 460. In the supply change mode 460, the controller 114 generates a visual and/or audible signal to alert the operator to change the main ink supply 202. In addition, the controller 114 operates the three-way valve 228 to fluidically couple the fluid line 224 with the fluid line 230. In addition, if necessary, the controller 114 operates the three-way valve 236 to fluidically couple the fluid line 234 with the fluid line 238. Thereafter, the fluid lines 222 and 242 may be decoupled from the ports 222 and 244, respectively, of the main ink supply 202. The main ink supply 202 may be replaced with a replacement main ink supply 202 that has sufficient ink by coupling the ports 222 and 244 of the replacement main ink supply 202 with the fluid lines 220 and 242, respectively. The operator may indicate to the controller 114 that the replacement ink supply 202 is in place, and the controller 114 returns to the run mode 456. In another embodiment, if the level of the ink in the main ink supply 202 falls below a level associated with the low ink sensor 350, the controller 114 generates a visual and/or audible signal to alert the operator to change the main ink supply 202 and stops operation of the ink supply 112 and the printing system 100 until the main ink supply 202 is replaced or refilled.

When the ink supply 112 is operating in the local recirculation mode 454, and filling of the lower reservoir 204 and the upper reservoir 206 of each of the ink supplies 112*a*, 112*b*, . . . , and 112*n* is completed, the controller 114 may operate the ink supply 112 in the bypass/recirculation mode 458 if printing is not ready be started, for example, if the fluid lines 308 and 314 of the ink supply unit 112 are not coupled to a printhead 108. In the bypass/recirculation mode 458, the controller 114 operates the three-way valve 298 to fluidically couple the fluid line 288 with the fluid line 302. In the bypass/recirculation mode 458, ink drains from the upper reservoir 206, through the fluid lines 280, 288, 302, 332 and 336, and into the lower reservoir 204. When the level of ink in the upper reservoir 206 is below the low ink level sensor 354, ink is transferred from the lower reservoir 204 to the upper reservoir 206 as described above. The ink circulates in the manner without passing through the flow regulation apparatus 208 between the upper reservoir 206 and the lower reservoir 204. Such recirculation keeps the ink in motion and prevents the ink from becoming stagnant.

When printing is to commence, the controller 114 may transition the ink supply unit 112 from the bypass/recirculation mode 458 to the run mode 456, and operate the ink supply unit in the run mode 456 as described above.

After printing is complete, the operator may place a cap (not shown) that covers the nozzle plate 400 of each printhead 108. The controller 114 continues to operate the ink supply unit 112 in the run mode 456 to keep the ink recirculating through the ink supply unit 112.

Alternately, the ink supply unit 112 may be operated in the bypass recirculation mode 458 described above, and the printhead 108 may be removed and flushed.

Further, if the ink supply unit 112 is not going to be used for an extended period of time, the operator may direct the controller 114 to shut down the ink supply unit 112. In response, the controller 114 operates the ink supply unit 112 in a drain mode 462. In the drain mode 462, the controller 114 operates the three-way valve 228 to fluidically couple the fluid line 224 and the fluid line 230, and the three-way valve 236 to fluidically couple the fluid line 234 with the fluid line 238. The controller 114 then directs the operator to replace the main ink supply tank 202 with a waste bottle (not shown) and direct the fluid line 242 into the waste bottle. In some cases, the operator may also be directed to remove the filter 268 and degasser 270 from the fluid line 250. If the filter 268 and the degasser 270 are removed, the operator couples portions 250*a*, 250*b*, and 250*c* of the fluid line 250 to one another. Thereafter, the controller 114 operates the three-way valve 236 to fluidically couple the fluid lines 234 with the fluid 242, and actuates the pump 232, which causes ink to drain from the lower reservoir 204 into the waste bottle, via the fluid lines 224, 230, 234, and 242.

Concurrently, the controller 114 closes the three-way valves 290 and 298 to stop ink in the upper reservoir 206 from draining into the lower reservoir 204, operates the three-way valve 258 to fluidically couple the fluid line 250 with the fluid line 260, and operates the pump 262 to draw ink from the lower reservoir 204 into the upper reservoir 206 via the fluid lines 250, 260, and 264. The controller 114 also operates the pressure control apparatus 348*b* to vent the port 344 to the air in the upper reservoir 206 displaced by the ink drawn from the lower reservoir 204. The pump 262 is operated until the level of the ink in the upper reservoir 206 is above the low ink level sensor 354.

After the upper reservoir 206 is filled, the controller 114 operates the three-way valve 290 to fluidically couple the fluid line 286 with the fluid line 292, and operates the three-way valve 298 to fluidically couple the fluid line 288 with the fluid line 300. The controller 114 also operates the valve 374 (FIG. 4) to fluidically couple the fluid line 370 with the fluid line 376 and the valve 392 to fluidically couple fluid line 390 with the fluid 394. Thereafter, the controller 114 operates the pressure control apparatus 348*b* to increase pressure in the upper reservoir 206 in bursts to force the ink from the upper reservoir 206 through the fluid lines 280, 286, 288, 300 and 318, and into the manifold 360. The bursts of pressure also force ink from the manifold 360 through the printhead 108 and into the manifold 364. Ink in the manifold 364 is forced through the fluid lines 322, 328, 326, 332 and 336, and into the lower ink reservoir 204. Such bursts of pressure are undertaken until all of the ink in the upper reservoir 206, the flow regulation apparatus 208, the printhead 108, the lower reservoir 204, and the fluid lines therebetween has been drained into the waste bottle. The controller 114 may direct the operator to check whether such ink has been drained or if any ink remains in the ink supply unit 112, for example, by checking whether any ink is coming out of the fluid line 242. After ink is drained from the ink supply unit 112, the ink pumps 232 and 262, and the pressure control apparatus 348 are turned off.

As noted above, the lower ink reservoir 204 includes a high ink level sensor 356. If the level of the ink in the lower ink reservoir 204 increases to a predetermined actuation level associated with the high ink level sensor 356, the controller 114 generates a visual or audible warning to alert the operator. If the level of the ink in the lower ink reservoir 204 does not drop below the predetermined actuation level within a predetermined amount of time, the controller 114 shuts down the ink supply unit 112, and in some cases, the printing system 100.

Similarly, the upper ink reservoir 206 includes a high ink level sensor 358. If the ink level in the upper ink reservoir 206 increases to a predetermined actuation level associated with the high ink level sensor 358, the controller 114 generates a visual or audible warning to alert the operator. In some embodiments, the controller 114 shuts down the ink supply unit 112 and, in some cases, the printing system 100 if the ink level in the upper reservoir 206 reaches the predetermined actuation level. In other embodiments, the controller 114 allows the ink supply 112 and the printing system 100 to continue to operate, but will shut down one or both if the level of the ink in the upper ink reservoir 206 does not drop below the predetermined actuation level associated with the high ink level sensor 358 within a predetermined amount of time.

Figure 6:
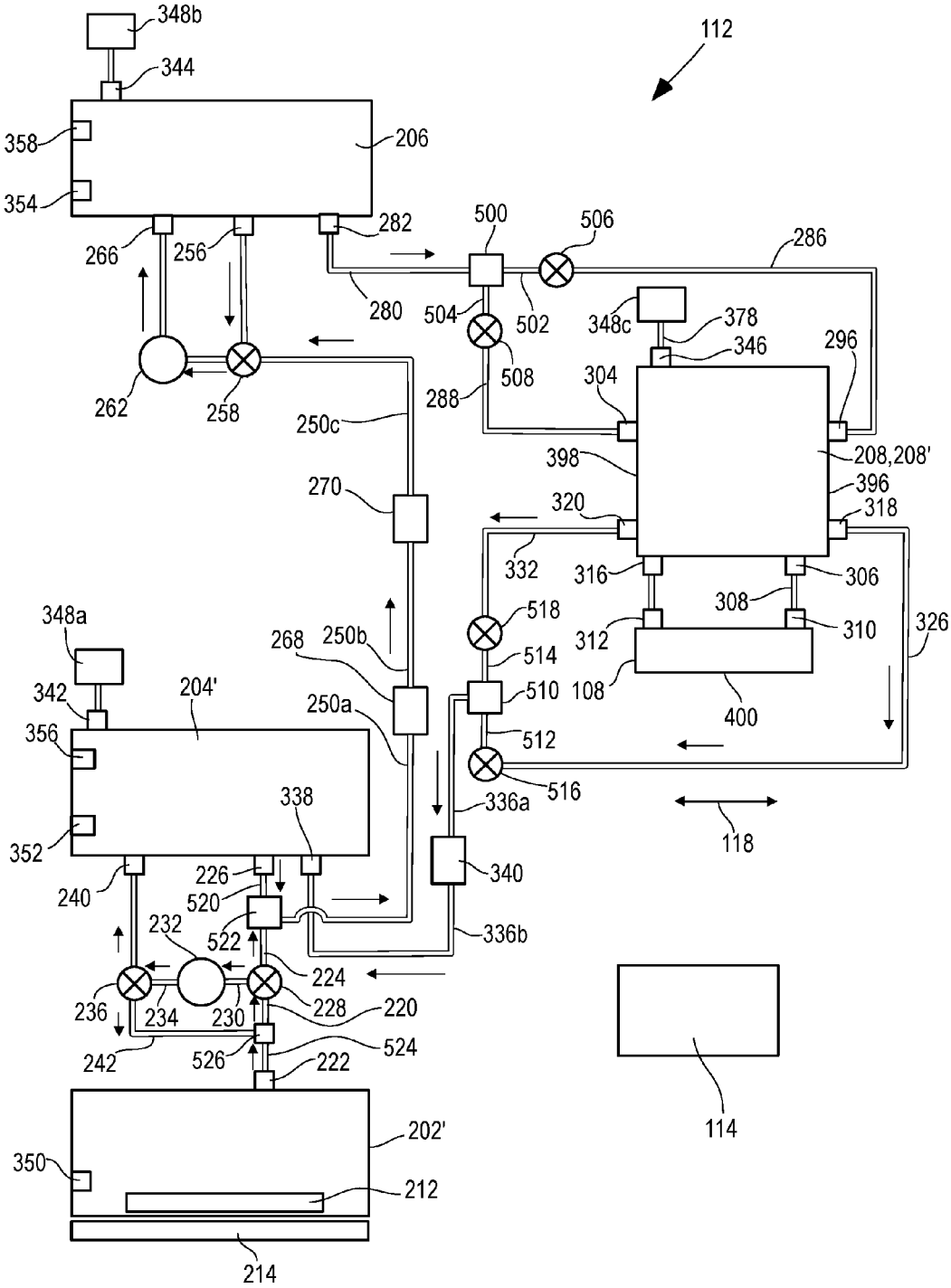
FIG. 6 is a block diagram of another embodiment of an ink supply unit of the printing system of FIG. 1.

Referring to FIGS. 3 and 6, in some embodiments (shown in FIG. 6), one or both of the t-connectors 284 and 334 may be replaced with a manifold block. For example, the t-connector 284 may be replaced with a manifold block 500 having channels 502 and 504. Fluid from the fluid line 280 that enters the manifold block 500 is directed into these channels 502 and 504. The channel 502 is coupled to the fluid line 286 via a two-way valve 506. The channel 504 is coupled to the fluid line 288 via a two-way valve 508. The controller 114 may open and/or close one or both of the valves 506 and 508 to direct ink from the line 280, via the manifold block 500 and channels 502 and 504, and into neither, one, or both of the fluid lines 286 and 288.

Similarly, the t-connector 334 may be replaced with a manifold block 510 having channels 512 and 514 and coupled to the fluid line 336*a*. The channel 512 is coupled to the fluid line 326 via a valve 516 and the channel 514 is coupled to the fluid line 332 via a valve 518. When the valves 516 and 518 are open, fluid from the fluid lines 326 and 332 enters the channels 512 and 514, and is directed through the manifold 510 and into the fluid line 336*a*. The controller 114 operates the valves 516 and 518 to direct fluid from neither, one, or both of the fluid lines 326 and 332 into the fluid line 336*a* via the channels 512 and 514 via the manifold 510.

In some embodiments, the lower reservoir 204 shown in FIG. 3 may be replaced by a similar lower reservoir 204' shown FIG. 5. The two lower reservoirs 204 and 204' are substantially identical except the lower reservoir 204' does not include the output port 252. Rather, ink from the output port 226 flows through a fluid line 520 and into a manifold block 522, which directs such ink into the fluid lines 224 and 250*a*. In some embodiments, the interior portions of the lower reservoirs 204 (and 204') and the upper reservoir 206 are substantially identical, and each such reservoir is filled with approximately 230 milliliters of ink before the sensor 352 and 354, respectively, is activated. The maximum volume of such reservoirs is approximately 340 milliliters. It should be apparent, that the ink supply 112 may be configured with smaller or larger reservoirs 204 and 206.

In some embodiments, the main ink supply 202 may be replaced by a main ink supply 202'. The main ink supplies 202 and 202' are substantially identical, except the main ink supply 202' does not include an ink output port. The output port 222 of the main supply 202' is coupled to a fluid line 524. The fluid lines 242 and 524 are coupled to a manifold block 526 so that fluid from these lines is directed into the fluid line 220. Referring also to FIG. 5, during the run mode 456 or the recirculate/bypass mode 458, the controller 114 opens the valves 228 and 236, and operates the pump 232 to circulate ink in the lines 220, 230, 234, and 242 as described above to reduce stagnation of ink during periods of minimal ink consumption. The lower reservoir 204 or 204' is filled with ink from the main ink supply 202' as needed during these modes as described above.

Figure 7:
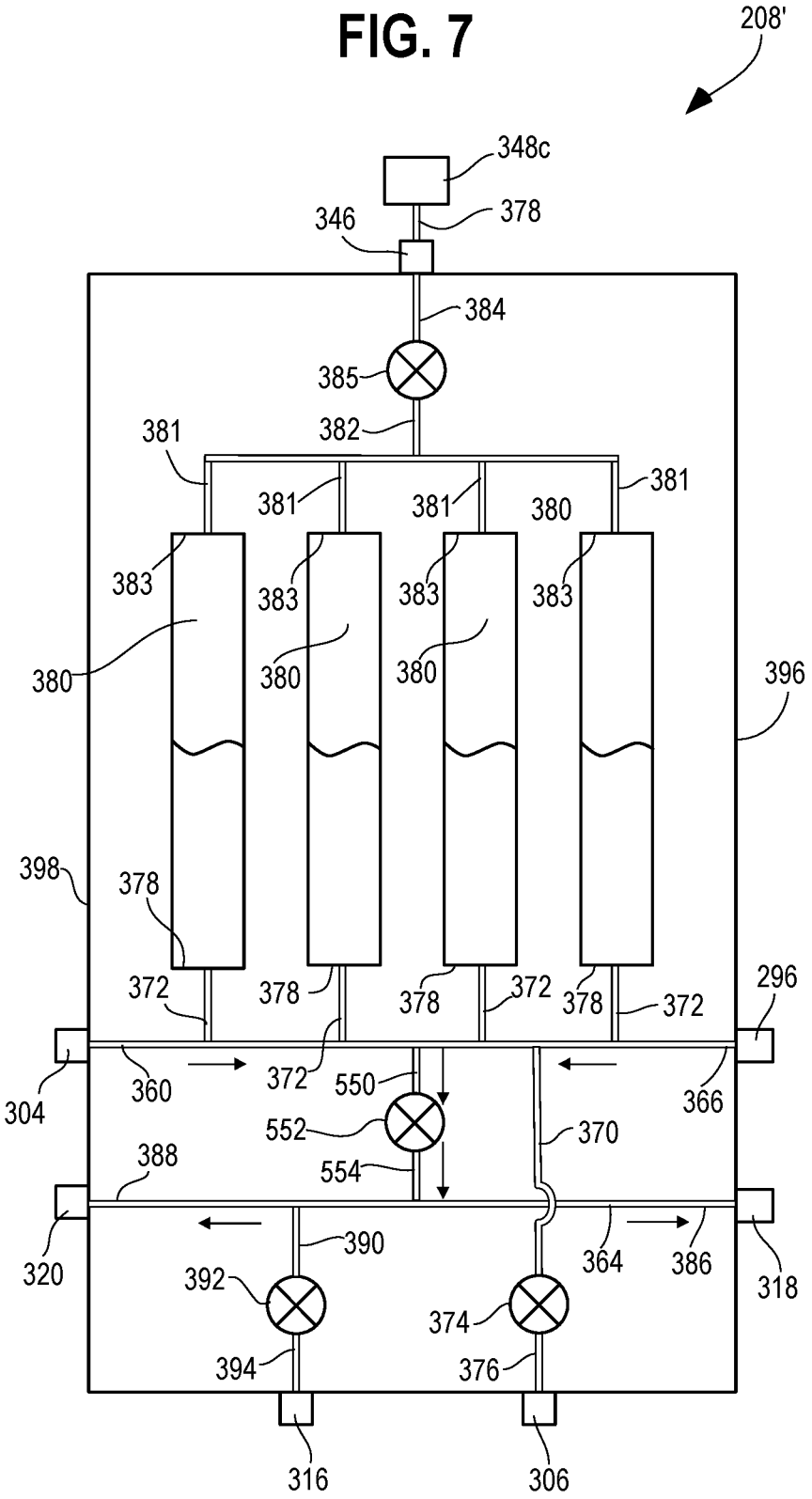
FIG. 7 is a block diagram of another embodiment of a flow regulation apparatus of the printing system of FIG. 1.

Referring to FIGS. 5 and 7, in some embodiments, the flow regulation apparatus 208 (FIG. 4) may be replaced with the flow regulation apparatus 208'. The flow regulation apparatus 208' is substantially identical to the flow regulation apparatus 208, except the fluid line 360 is fluidically coupled to a fluid line 550, the fluid line 550 is fluidically coupled via a valve 552 to a fluid line 554, and the fluid line 554 is fluidically coupled to the fluid line 364.

In this arrangement, for example, during the run mode 456, the controller 114 closes the valve 552, and opens the valves 374 and 392, so that ink in the fluid line 360 is directed into the printhead 108 via the fluid line 370, the valve 374, the fluid line 376, the port 306, the fluid line 308 and the port 310. Ink that enters the printhead 108 may be ejected through the nozzle plate 400 for printing, or may be returned to the fluid line 364 via the port 312, the fluid line 314, the port 316, the fluid line 394, the valve 392, and the fluid line 390. Ink that enters the fluid line 364 returns to the lower ink reservoir 204 or 204' via the fluid lines 332 and 336 (and valves and/or manifolds disposed therebetween).

Further, during the bypass/recirculation mode 458, the controller 114 opens the valve 552 to allow ink to flow from the fluid line 360 into the fluid line 364, bypassing the printhead 108, to recirculate the ink between the upper ink reservoir 206 and the lower ink reservoir 204, 204'.

In some embodiments, the flow regulation apparatus 208 or 208' is implemented with a manifold block. In such embodiments, one or more of the fluid lines of the flow regulation apparatus 208 or 208' described above may be fluid pathways of such manifold block. However, in such embodiments, ink is transported through such fluid pathways of the manifold blocks in a manner substantially identically to the transport of ink through the fluid lines described above.

Referring to FIGS. 5-7, as described above, the controller 114 undertakes a series of bypass purge cycles to force ink into fluid lines of the ink supply 112. As described above, during a bypass purge cycle, air in the fluid lines of the ink supply unit 112 is replaced with ink. The bypass purge cycle does not consume any ink and no fluid flows through the printhead 108. In one embodiment, one bypass purge cycle purges air from the fluid lines that enter and exit the side 396 of the flow regulation apparatus 208', and thereafter another purge cycle purges air from the fluid lines that enter and exit the side 398 of the flow regulation apparatus 208'. Alternately, a series of bypass purge cycles may be undertaken to purge air from fluid lines that enter and exit the side 398, and then another series of purge cycles may be undertaken to purge air from the fluid lines that enter and exit the side 396.

To purge the air from the fluid lines that enter and exit the side 396, the controller 114 shuts the valves 374 and 392 to fluidically decouple the printhead 108 from the flow regulation apparatus 208'. In addition, the controller 114 opens the valves 506 and 516 to fluidically couple the fluid lines 286 and 326 to the upper reservoir 206 and the lower reservoir 204', respectively. The controller 114 shuts the valves 508 and 518 to fluidically decouple the fluid lines 288 and 332 from the upper reservoir 206 and the lower reservoir 204' respectively. The controller 114 also shuts the valve 385 and opens the valve 552. Thereafter, the controller 114 operates the pressure control apparatus 348*b* to increase the pressure in the upper reservoir 206. Such increase in pressure causes ink to flow from the port 282 of the upper reservoir 206, through the fluid line 280, the manifold block 500, the fluid passageway 502, the valve 506, the fluid line 286 and into the flow regulation apparatus 208' via the port 296. Ink that enters the port 296 flows through the passageway 360 and into the standpipes 380 compresses the air in the ullage above the ink therein. In addition, ink flows through the fluid lines 550, the valve 552, the fluid lines 554, the passageway 386, and exits the flow regulation apparatus 208' via the port 318. From the port 318, the ink flows through the fluid line 326, the valve 516, the manifold 510, through the lines 336, and into the lower reservoir 204' via the port 338.

Similarly, to purge the air from the fluid lines that enter and exit the side 398, the controller 114 shuts the valves 374 and 392 to fluidically decouple the printhead 108 from the flow regulation apparatus 208', and opens the valves 508 and 518 to fluidically couple the fluid lines 288 and 332 to the upper reservoir 206 and the lower reservoir 204', respectively. The controller 114 then shuts the valves 506 and 516 to fluidically decouple the fluid lines 286 and 326 from the upper reservoir 206 and the lower reservoir 204' respectively. The controller 114 also shuts the valve 385 and opens the valve 552. Thereafter, the controller 114 operates the pressure control apparatus 348*b* to increase the pressure in the upper reservoir 206 as described above to force ink from the port 282 of the upper reservoir 206, through the fluid line 280, the manifold block 500, the fluid passageway 504, the valve 508, the fluid line 288 and into the flow regulation apparatus 208' via the port 304. Ink that enters the port 304 flows through the passageway 360 and into the standpipes 380 and compresses the air in the ullage above the ink therein. In addition, the ink flows through the fluid lines 550, the valve 552, the fluid lines 554, the passageway 386, and exits the flow regulation apparatus 208' via the port 320. From the port 320, the ink flows through the fluid line 332, the valve 518, the manifold 510, through the lines 336, and into the lower reservoir 204' via the port 338.

During each bypass purge cycle, the controller 114 maintains the increased pressure in the upper reservoir 206 for a predetermined amount of time. In one embodiment, such predetermined amount of time is between approximately 5 seconds and 10 seconds. During such time, the ink level in the standpipes 380 rises and compresses the air in the ullage above the ink in the standpipes 380. After the predetermined amount of time has elapsed, the controller 114 reduces the pressure in the upper reservoir 206 to a predetermined vacuum pressure. This reduces flow of ink through flow regulation apparatus 208 and the ink level in the standpipes 380 falls.

In one embodiment, during the bypass purge cycle, the controller 114 operates the pressure control apparatus 348*b* to increase the pressure in the upper reservoir 206 by approximately 15 pounds per square inch (approximately 103 Kilopascal). Further, in one embodiment, during the purge cycle the controller operates the pressure control apparatus 348*a* to maintain the lower reservoir 204' at a predetermined vacuum pressure that is below ambient pressure.

If the level of the ink in the upper reservoir 206 falls below the level of the low ink level sensor 354 during a purge cycle described above, ink is pumped from the lower reservoir to the upper reservoir as described above.

The controller 114 undertakes multiple bypass purge cycles to insure air has been forced out of the fluid lines 286, 288, 326 and 332, and the fluid passageways and lines of the flow regulation apparatus 208', and replaced with ink. In some embodiments, the controller 114 alternates between purging air from the lines 286 and 326 and purging air from the lines 288 and 332. In other embodiments, the controller 114 performs a predetermined number of air purge cycles that purge air from the lines 286 and 326, and then performs the predetermined number air purge cycles that purge air from the lines 288 and 332. The controller 114 may undertake other combinations of air purge cycles as would be apparent to one who has ordinary skill in the art.

In one embodiment, three bypass purges, each lasting approximately eight seconds are used on each side of the pressure control apparatus 208 when empty fluid lines are initially filled with ink. In addition, the operator may direct the controller 114 to undertake additional bypass purges to remove small air bubbles from fluid lines already filled with ink. In such cases, one to two such additional bypass purges, each lasting between approximately five and approximately eight seconds, may be undertaken.

In addition to the bypass purge cycle described above, the controller 114 may undertake one or more cross purge cycles to force the ink to move through the lines of the ink supply unit 112 and the printhead 108. The controller 114 couples the fluid lines of the ink supply unit 112 to the printhead 108 as described above in connection with the run mode 456 (FIG. 5). The controller 114 then operates the pressure control apparatus 348*b* to increase the pressure in the upper reservoir 206 to force ink from the upper reservoir 206, through the printhead 108, and to the lower reservoir 204. Such cross purge cycle(s) may be used when the printhead 108 is coupled initially coupled to the ink supply unit 112.

Further, the controller 114 may undertake a regular purge cycle to expel ink through the orifices of the nozzle plate 400 of the printhead 108. Such regular purge cycle may be undertaken, for example, to force ink into the printhead 108 or to forcibly remove debris from such orifices. To undertake the regular purge cycle, the controller 114 couples the fluid lines to the printhead 108 as they would be during the run mode 456 (FIG. 5), then closes the valve 392 to decouple the return line 314 from the printhead 108 and the manifold 364. Thereafter, the controller 114 operates the pressure control apparatus 348*b* to increase pressure in the upper reservoir 206 to force ink through the printhead 108.

Figure 8:
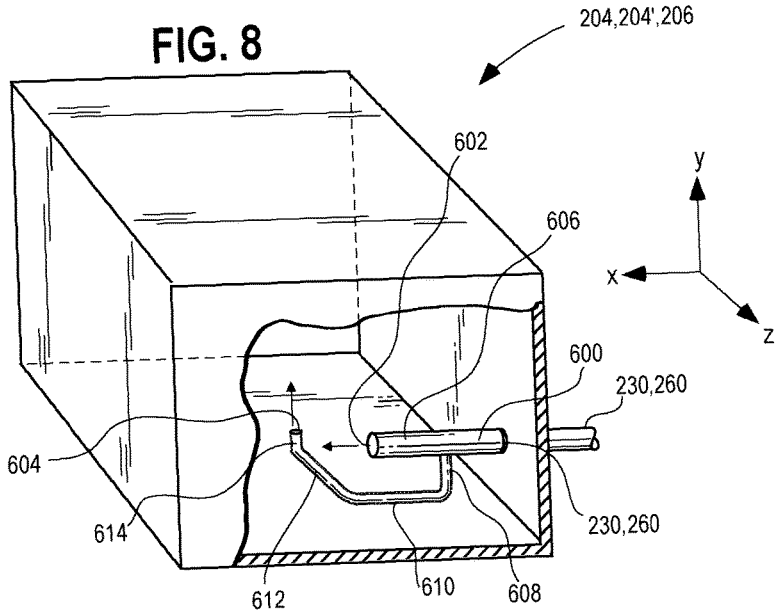
FIG. 8 is an isometric view of a reservoir of the ink supply unit of FIG. 3, with a portion of the front face and some internal components removed.

Referring to FIG. 8, to aid in agitation of the ink in the lower reservoir 204 or 204', and the upper reservoir 206, in some embodiments the port 226 of the lower reservoir 204 and/or the port 240 of the upper reservoir 206 may be coupled to a manifold 600. The manifold 600 includes at least two output ports 602 and 604 that are separated from one another along the X-, Y-, and Z-axis. Further, the two ports 602 and 604 are oriented so that ink exits from the two ports in different directions. In one embodiment, the two ports 602 and 604 are oriented so that ink exits therefrom in directions orthogonal to one another.

In one embodiment, the manifold 600 includes a first portion 606 that extends into the reservoir in a direction parallel to the X-axis and terminates in the output port 602. The manifold includes a second portion 608 coupled to the first portion 606 that extends downward in a direction parallel to the Y-axis, a third portion 610 coupled to the second portion 608 that extends inward in a direction parallel to the X-axis, a fourth portion 612 coupled to the third portion 610 that extends inward along a direction parallel to the Z-axis, and a fifth portion 614 coupled to the fourth portion 612 that extends upward along a direction parallel to the Y-axis. The fourth portion 612 terminates in the port 604. In some embodiments, the diameters of the first port 602 and the second port 604 may be different so that ink flows through such port at different velocities. Such differences in position of the first port 602 and the second port 604, the directions in which the ink exits the first port 602 and the second port 604, and the velocity with which the ink exits these ports 602 and 604 creates turbulence to agitate the ink in the lower ink reservoir 204 and/or the upper ink reservoir 206. Ink entering the reservoir 204, 204' and/or 206 from the port 602 creates a swirling effect in the ink in such reservoir and the ink entering from the port 604 forces ink up from the bottom of such reservoir. In some embodiments, the interior portions of the one or more of the lower ink reservoir 204 or 204' and the upper ink reservoir 206 are cylindrical.

Figure 9:
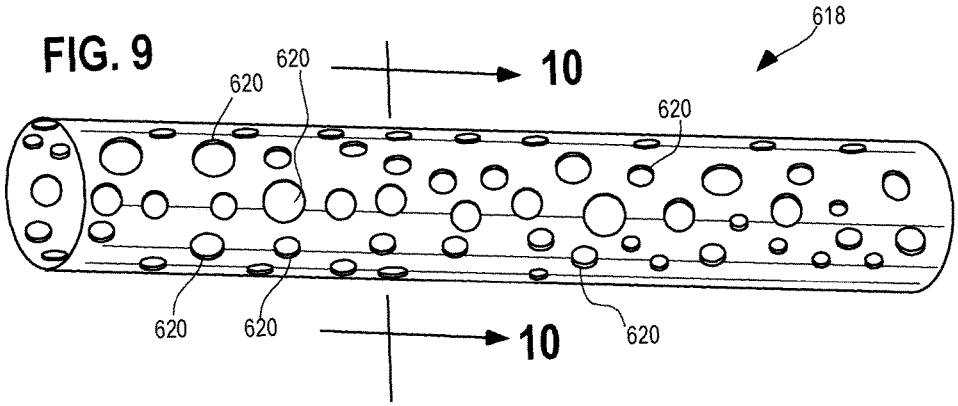
FIG. 9 is a fragmentary isometric view of a portion of a fluid line of the ink supply unit of FIG. 3.
Figure 10:
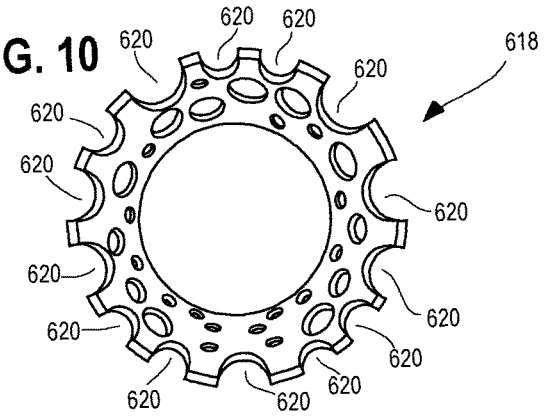
FIG. 10 is a sectional view taken generally along the line 10-10 of FIG. 9.

Referring to FIGS. 9 and 10, in some embodiments, one or more portion(s) 618 of one or more of the fluid line(s) 220, 224, 230, 234, 238, 242, 250, 254, 260, 264, 280, 286, 288, 292, 294, 300, 302, 308, 314, 326, 332, 328, and 336 has a non-smooth surface that, for example, indentations 620 thereon. These indentations 620 disrupts the flow of the ink as it travels such portion 618 and agitates the ink to prevent settling of the components of the ink in such fluid line(s).

Figure 11:
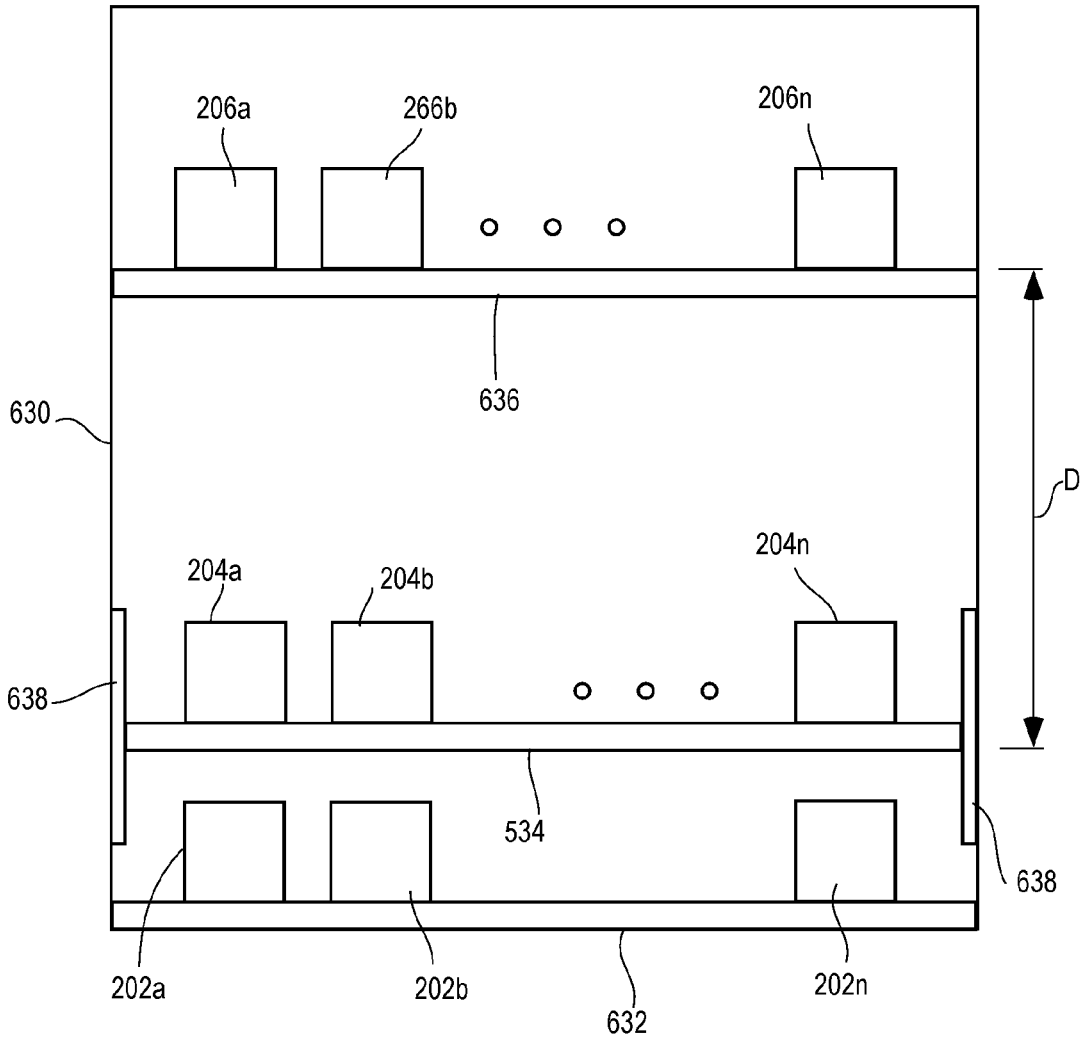
FIG. 11 is a block diagram of an ink supply cabinet in which the ink supply unit of FIG. 3 may be disposed.

Referring to FIG. 11, the main ink supplies 202*a*, 202*b*, . . . , 202*n*, the lower ink reservoirs 204*a*, 204*b*, . . . , 204*n*, and the upper ink reservoirs 206*a*, 206*b*, . . . , 206*n* the ink supply units 112*a*, 112*b*, . . . , 112*n* are disposed in an ink supply cabinet 630. For example, the ink supply cabinet 630 includes shelves 632, 634, and 636. The main ink supplies 202 are disposed on the shelf 632, the lower ink reservoirs 204 are disposed on the shelf 634, and the upper ink reservoirs 206 are disposed on the shelf 636. The distances $D_a$, $D_b$, . . . $D_n$ between the lower reservoirs 204*a*, 204*b*, . . . 204*n* and the upper reservoirs 206*a*, 206*b*, . . . 206*n*, respectively, may be individually adjusted to compensate for differences in viscosity and/or density of different inks in such reservoirs. Such adjustment affects the relative vacuum seen by the printhead 108 and the natural gravity driven recirculation rate of the ink supply units 112.

In a preferred embodiment, the output port 282 of the upper reservoir 206 is disposed at a height above the ground that is equal to or higher than the height of the nozzle plate 400. The lower reservoir 204 or 204' is disposed at a height from the ground that is less than the height at which the upper reservoir 206 is disposed. Such height difference between upper reservoir 206 and the lower reservoir 204 (204') facilitates flow of fluid from the upper reservoir 206, through the printhead 108, and to the lower reservoir 204 (204') due to gravity. The difference in height from the ground between the upper reservoir 206 and the lower reservoir 204 (204') is between approximately 11 inches (27.9 centimeters) and approximately 18 inches (45.72 centimeters). Additional vacuum may need to be supplied by the pressure regulation apparatus 348*b* to the upper reservoir 206 and the lower reservoirs 204 (204') as the distance between the upper reservoir 206 and the nozzle plate 400 increases.

The height difference between the lower reservoir 204 or 204' and upper reservoir 206 or 206' associated is determined by architecture of the printhead 108, characteristics of the ink or fluid that supplied by the ink supply unit 112, and head losses throughout the path from the upper reservoir 206 or 206' to the printhead 108 and from the printhead 108 to the lower reservoir 204 or 204'. For example, as the number of fittings and manifolds in such path increases, the distance between the reservoirs increases.

In some embodiments, one or more of the fluid lines 220, 224, 230, 234, 238, 242, 250, 254, 260, 264, 280, 286, 288, 292, 294, 300, 302, 308, 314, 326, 332, 328, and 336 may be routed between the components of the ink supply 112 and between the ink supply unit 112 and the printhead 108 using a fluid management system such one manufactured by Igus® Inc., of East Providence, R.I.

The ink supply unit 112 described above maintains continuous motion of ink therethrough to prevent components in the ink from settling. Although such ink supply unit 112 is particularly suited for inks that have components that may settle, the ink supply unit 112 may be used for any type of ink or even a non-ink fluid. Further, the ink supply unit 112 may be used with printing systems 100 that have stationary printheads 108 and with printing systems 100 that have traversing printheads 108. Further, it should be apparent that one or more operations described herein that are undertaken by an operator may be undertaken by a combination of a robotic system and/or sensor coupled to the controller 114.

INDUSTRIAL APPLICABILITY

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

We claim:

1. An ink supply system, comprising:

a lower ink reservoir;

an upper ink reservoir coupled to the lower ink reservoir;

a printhead movable along an axis;

a flow regulation apparatus movable parallel to the axis;

first and second fluid input ports disposed on opposite sides of the flow regulation apparatus wherein the first and second fluid input ports are adapted to permit fluid flow into the flow regulation apparatus parallel to the axis;

a first fluid line and a second fluid line, wherein the first fluid line and the second fluid line couple the first and the second input ports, respectively, with the upper ink reservoir; and a third fluid line coupling the flow regulation apparatus with the printhead.

2. The ink supply system of claim 1, wherein the flow regulation apparatus includes a standpipe, and the first and the second fluid input ports are coupled to the standpipe.

3. The ink supply system of claim 2, wherein the first and the second fluid input ports and the standpipe are coupled to the third fluid line.

4. The ink supply system of claim 1, wherein the lower ink reservoir and the upper ink reservoir are disposed so that fluid in the upper ink reservoir is transferred to the lower ink reservoir substantially only by gravity.

5. The ink supply system of claim 4, wherein the fluid transferred substantially only by gravity is transferred through the flow regulation apparatus.

6. The ink supply system of claim 5, further comprising a pump that transfers fluid in the lower ink reservoir to the upper ink reservoir.

7. The ink supply system of claim 1, further including a fourth fluid line that delivers ink to the upper ink reservoir, wherein the fourth fluid line is coupled to a manifold disposed in the upper ink reservoir, and the manifold includes two output ports.

8. The ink supply system of claim 7, wherein the two output ports are oriented to output a fluid therefrom in different directions.

9. The ink supply system of claim 8, wherein one of the first fluid line, the second fluid line, and the third fluid line comprises a non-smooth surface.

10. The ink supply system of claim 1, further including a first pump that recirculates ink in the upper ink reservoir and a second pump that recirculates ink in the lower ink reservoir.

11. The ink supply system of claim 1 in combination with an ink supply, wherein the ink supply is coupled to the lower ink reservoir.

12. The ink supply system of claim 1, wherein the flow regulation apparatus moves relative to the upper ink reservoir and the lower ink reservoir while fluid from the upper ink reservoir is transported through the flow regulation apparatus.

13. The ink supply system of claim 1, further including a valve, a fourth fluid line coupled to the lower ink reservoir, and fifth and sixth fluid lines coupled to the upper ink reservoir, wherein the valve selectively couples the fourth fluid line to one of the fifth and the sixth fluid lines.

14. The ink supply system of claim 1, further including a pressure control apparatus coupled to the upper ink reservoir, wherein the pressure control apparatus increases the pressure in the upper ink reservoir to force fluid in the upper ink reservoir into the flow regulation apparatus.

15. A method of supplying ink, the method comprising the steps of:

coupling a lower ink reservoir with an upper ink reservoir;

coupling the upper ink reservoir with first and second input ports of a flow regulation apparatus, wherein the first and second input ports are disposed on opposite sides of the flow regulation apparatus;

moving the flow regulation apparatus along an axis as ink is delivered through the first and second input ports parallel to the axis; and providing a fluid line adapted to couple the flow regulation apparatus with a printhead.

16. The method of claim 15, further including the step of coupling the first and second input ports with a standpipe.

17. The method of claim 16, further including the step of coupling the standpipe with the fluid line.

18. The method of claim 15, further including the step of transferring a fluid from the upper ink reservoir to the lower ink reservoir substantially only by gravity.

19. The method of claim 18, wherein the step of transferring the fluid comprises the step of transferring the fluid through the flow regulation apparatus.

20. The method of claim 18, wherein the step of transferring the fluid comprises the step of transferring fluid in the lower ink reservoir to the upper ink reservoir.

21. The method of claim 15, further comprising the step of delivering a fluid into the upper ink reservoir through two output ports disposed inside the ink reservoir.

22. The method of claim 21, wherein the step of delivering the fluid delivers a first portion of the fluid in a first direction and a second portion of the fluid in a second direction different from the first direction.

23. The method of claim 15, comprising the further step of recirculating fluid in the upper reservoir.

24. The method of claim 15, comprising the further step of coupling the lower ink reservoir to an ink supply.

25. The method of claim 15, further comprising the steps of moving the flow regulation apparatus relative to the upper reservoir and the lower reservoir and simultaneously transporting a fluid through the flow regulation apparatus.

26. The method of claim 15, further comprising the step of selectively coupling an input port of the upper reservoir with one of an output port of the upper reservoir and an output port of the lower reservoir.

27. The method of claim 15, further including the step of increasing pressure in the upper reservoir to force fluid in the upper reservoir into the flow regulation apparatus.

* * * * *